US007954641B2

(12) United States Patent
Calendrille, Jr. et al.

(10) Patent No.: US 7,954,641 B2
(45) Date of Patent: Jun. 7, 2011

(54) DISPLAY PACKAGING FOR AN ANIMATED TOY

(75) Inventors: John Calendrille, Jr., Coram, NY (US); Bruce D. Lund, River Forest, IL (US); Michael D. Starrick, Maywood, IL (US); Krishnan Srirangam, Chicago, IL (US)

(73) Assignee: Lund & Company Invention LLC, River Forest, IL (US)

( * ) Notice: Subject to any disclaimer, the term of this patent is extended or adjusted under 35 U.S.C. 154(b) by 0 days.

(21) Appl. No.: 12/621,693

(22) Filed: Nov. 19, 2009

(65) Prior Publication Data

US 2010/0065451 A1 Mar. 18, 2010

Related U.S. Application Data

(62) Division of application No. 11/261,922, filed on Oct. 31, 2005, now Pat. No. 7,641,052.

(60) Provisional application No. 60/623,242, filed on Nov. 1, 2004, provisional application No. 60/678,798, filed on May 9, 2005.

(51) Int. Cl.
*B65D 25/54* (2006.01)
*A63H 11/08* (2006.01)

(52) U.S. Cl. ..... 206/779; 206/775; 446/324

(58) Field of Classification Search ..... 206/779, 206/738, 745, 754, 762, 765, 45.26, 761, 206/775, 756, 758, 599, 477; 229/199; 446/72, 446/73, 75, 324, 353, 236, 268, 308, 322, 446/325, 326, 311, 312, 376, 383, 330
See application file for complete search history.

(56) References Cited

U.S. PATENT DOCUMENTS

| | | | |
|---|---|---|---|
| 163,696 | A | 5/1875 | Safford |
| 462,150 | A | 10/1891 | Murray |
| 895,186 | A | 8/1908 | Killman |
| 1,407,746 | A | 2/1922 | Hagarty |
| 1,411,944 | A | 4/1922 | Wagner |
| 1,634,765 | A | 7/1927 | Yankelewitz |
| 1,859,401 | A | 5/1932 | Lengsfield |
| 1,865,837 | A | 7/1932 | Connor |
| 2,021,588 | A | 11/1935 | Baker |
| 2,364,253 | A | 12/1944 | Thomas |
| 2,389,365 | A | 11/1945 | Whitaker |
| 2,669,799 | A | 3/1951 | Stiteler |
| 2,572,752 | A | 10/1951 | Ostrander |

(Continued)

FOREIGN PATENT DOCUMENTS

| | | |
|---|---|---|
| DE | 3626113 | 2/1986 |

(Continued)

*Primary Examiner* — J. Gregory Pickett
*Assistant Examiner* — Ernesto A Grano
(74) *Attorney, Agent, or Firm* — Edell, Shapiro & Finnan, LLC

(57) ABSTRACT

The present invention is directed toward a display package for an animated doll or similar toy product that facilitates demonstration of the toy's animated features. The display package provides an enclosure that houses the doll. The doll includes an animation mechanism that drives a portion of the toy from a first position to a second position. The display package may include a moveable display panel mounted within the enclosure. The display panel is selectively engaged by the toy when the animation mechanism is engaged. The display package may include a support member that supports the toy within the package and permits the animation mechanism to move the doll from a first display position to a second display position.

17 Claims, 21 Drawing Sheets

U.S. PATENT DOCUMENTS 2,660,811 A 12/1953 Black
2,698,498 A 1/1955 Muller
2,723,747 A 11/1955 Oxenfeld
2,809,834 A 10/1957 Frampton
2,958,144 A 11/1960 Stranges et al.
3,009,284 A 11/1961 Ryan
3,279,736 A 10/1966 Vogt, III
3,324,997 A 6/1967 Bonanno
3,392,823 A 7/1968 Green et al.
3,414,265 A 12/1968 Marks
3,500,577 A 3/1970 Bart
3,672,092 A 6/1972 Tepper et al.
3,728,815 A 4/1973 Tomiyama
3,740,543 A 6/1973 Franc
3,787,999 A 1/1974 Ayton et al.
3,811,565 A 5/1974 Tancredi
3,974,593 A 8/1976 Walker, Jr.
4,026,066 A 5/1977 Reiner et al.
4,040,206 A * 8/1977 Kimura ..... 446/352
4,069,613 A * 1/1978 Lemelson et al. ..... 446/365
4,141,176 A 2/1979 Flicker et al.
4,165,579 A 8/1979 Chase
4,186,516 A 2/1980 Ensmann
4,407,083 A 10/1983 Hartgrave
4,530,672 A 7/1985 Yoneda
4,573,939 A 3/1986 Hoshino
4,723,932 A 2/1988 Kelley
4,842,131 A 6/1989 Mandelbaum
4,925,025 A 5/1990 Anten et al.
4,929,216 A 5/1990 Morris et al.
5,013,276 A 5/1991 Garfinkel
5,120,263 A 6/1992 Ierfino et al.
5,172,806 A 12/1992 Mickelberg
5,188,222 A 2/1993 Pierce
5,211,282 A 5/1993 Ting
5,275,279 A 1/1994 Grigsby
5,289,916 A 3/1994 Mickelberg
5,308,276 A 5/1994 Fogarty et al.
5,411,138 A 5/1995 Klawiter
5,413,517 A 5/1995 Kamijima
5,529,174 A 6/1996 McQueeny
5,580,295 A 12/1996 Ruzskai et al.
5,601,471 A 2/1997 Kennedy
5,718,335 A 2/1998 Boudreaux
5,759,082 A 6/1998 Kujawski et al.
5,795,209 A 8/1998 Moore
5,853,315 A * 12/1998 Satoh ..... 446/301
5,881,884 A 3/1999 Podosek
5,919,074 A 7/1999 Honda
5,957,294 A 9/1999 Kanter
6,047,833 A 4/2000 Salomon
6,273,779 B1 8/2001 Boulaire
6,319,087 B1 11/2001 Ferrigno
6,409,568 B1 6/2002 Soggard et al.
6,520,828 B2 2/2003 Ferrigno
6,672,935 B1 1/2004 Lund
6,681,953 B2 1/2004 Au
6,746,301 B1 6/2004 Lund et al.
6,749,437 B2 6/2004 Chan
6,755,306 B2 6/2004 Maus
6,808,432 B1 10/2004 Davis et al.
7,413,111 B2 8/2008 Quaintance
7,422,506 B2 * 9/2008 Lund et al. ..... 446/324
2003/0146130 A1 8/2003 Kanter et al.
2004/0152395 A1 8/2004 Podd et al.
2005/0218036 A1 10/2005 Ahn

FOREIGN PATENT DOCUMENTS

JP 2004/089350 3/2004

* cited by examiner

DISPLAY PACKAGING FOR AN ANIMATED TOY

CROSS-REFERENCE TO RELATED APPLICATIONS

This application is a divisional of U.S. patent application Ser. No. 11/261,922, entitled "Display Packaging for an Animated Toy" and filed 31 Oct. 2005, which claims priority to U.S. Provisional Application No. 60/623,242, entitled "Packaging for Animated Figure" and filed on 1 Nov. 2004, and to U.S. Provisional Application No. 60/678,798, entitled "Display Package for Animated Toy" and filed 9 May 2005. Each disclosure of the aforementioned applications is incorporated herein by reference in its entirety.

BACKGROUND OF THE INVENTION

The rapid and virtually unlimited development of toy products within the marketplace has been to some extent paced by a similar dramatic rate of development in product packaging and product packaging techniques. Thus, as toy products have become increasingly entertaining, amusing, colorful, complex, and sophisticated, packaging for toy products has endeavored to provide evermore interesting, amusing, informative, and attractive packaging. In addition to the basic function of toy product packaging, which provides protection and convenient shipping and product handling containers for the products, designers of toy packaging expend great effort on making the packaging for toy products colorful, interesting, eye-catching, and entertaining. One of the more significant improvements to be provided by designers of toy packaging may be generally described as "try-me" feature packaging. This type of packaging acquired its name from the capability of displaying and supporting the product in a manner which allows and encourages a potential purchaser to, in a limited sense, try the product without removing it from the packaging. Thus the objective of "try-me" packaging is to provide an environment in which the product may be to some extent tried or demonstrated, without compromising the integrity of the packaging, or its protection and retention of the product.

SUMMARY OF THE INVENTION

Accordingly, the present invention is directed toward a display package for an animated toy (e.g., a doll) or similar product that facilitates demonstration of the toy's or similar product's animated features. The display package defines an enclosure that houses the toy. The toy includes an animation mechanism that drives at least a portion of the toy from a first position to a second position (and vice versa). In one embodiment of the invention, the display package includes a moveable display panel mounted within the enclosure. The display panel is selectively engaged by the toy when the animation mechanism is engaged. The invention further relates to an attachment for the display package configured to stabilize the moveable display panel. In another embodiment, the display package includes a support member configured to support the toy within the package and permit the animation mechanism to move the doll from a first display position to a second display position.

BRIEF DESCRIPTION OF THE DRAWINGS

Like reference numerals have been used to identify like elements throughout this disclosure.

DETAILED DESCRIPTION OF THE INVENTION

The current invention is directed toward display packaging for an animated doll or similar toy product and, in particular, to display packaging that facilitates demonstration of an action feature of the animated toy (e.g., a doll) or similar product. The animated toy, housed in a display package in accordance with the present invention, may include a portion which repeatedly moves from a first position to a second position and vice versa. The display package of the present invention is an enclosure for the animated toy, where the enclosure may have a rear package portion, a front package portion, side package portions extending between the rear package portion and the front package portion, and a bottom package portion extending between the rear package portion and the front package portion.

In accordance with one embodiment of the present invention, the display package may also include a moveable display panel mounted to the package. The display panel may be configured to move from a first display panel position to a second display panel position when contacted by the portion of the animated toy that repeatedly moves from a first toy position to a second toy position. The repeated movement of the portion of the animated toy from the first toy position to the second toy position and vice versa, then, causes a corresponding, repeating movement of the display panel from the first display panel position the second display panel position and vice versa.

In another embodiment of the invention, the display package may further include a removable attachment that secures the display panel in either its first or second position, as well as secures and protects the toy within the package. In accordance with yet another embodiment of the invention, the display package may include a post configured to support the toy and allow the rotation of the toy about the post while positioned within the packaging.

Figure 1:
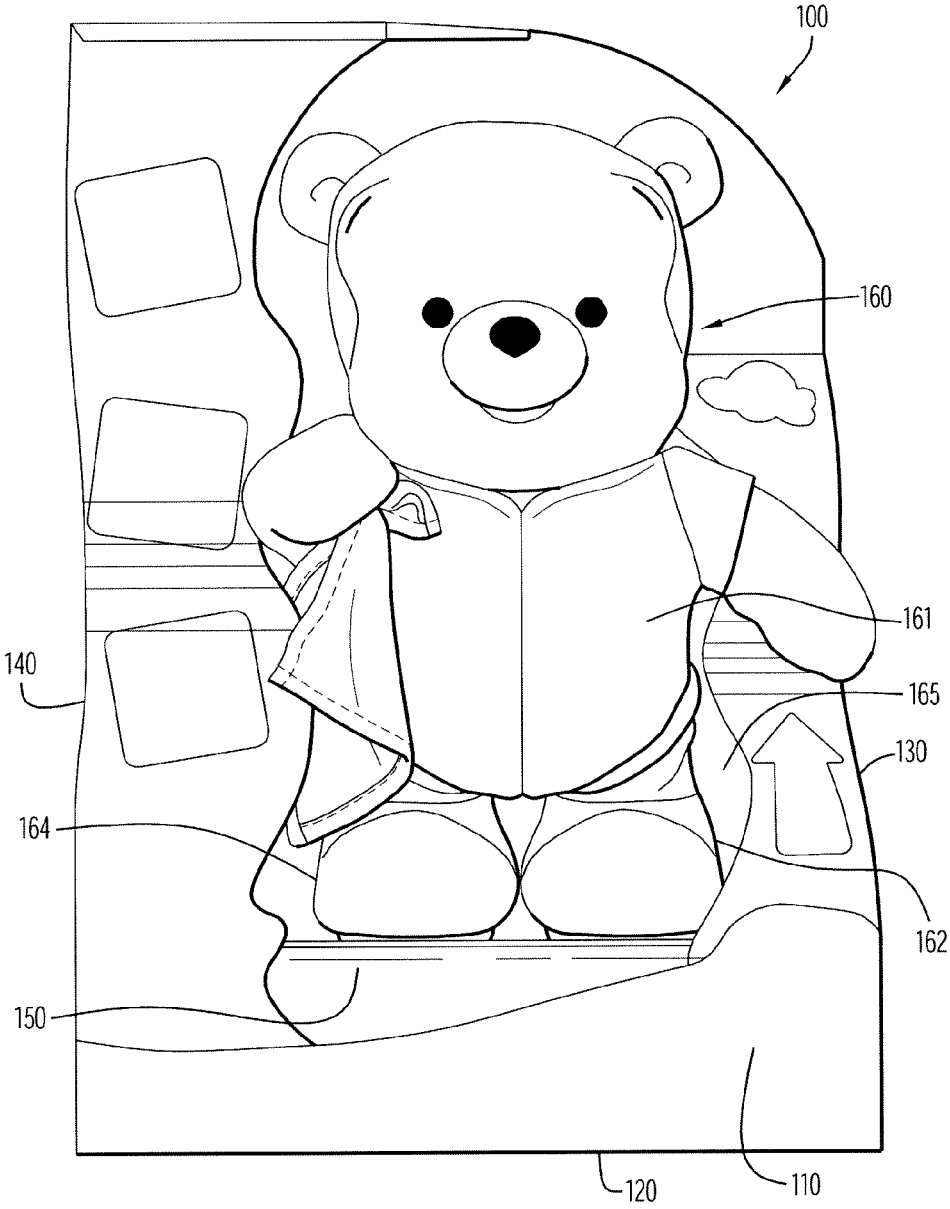
FIG. 1 illustrates a front view of the display packaging in accordance with an embodiment of the present invention.
Figure 2:
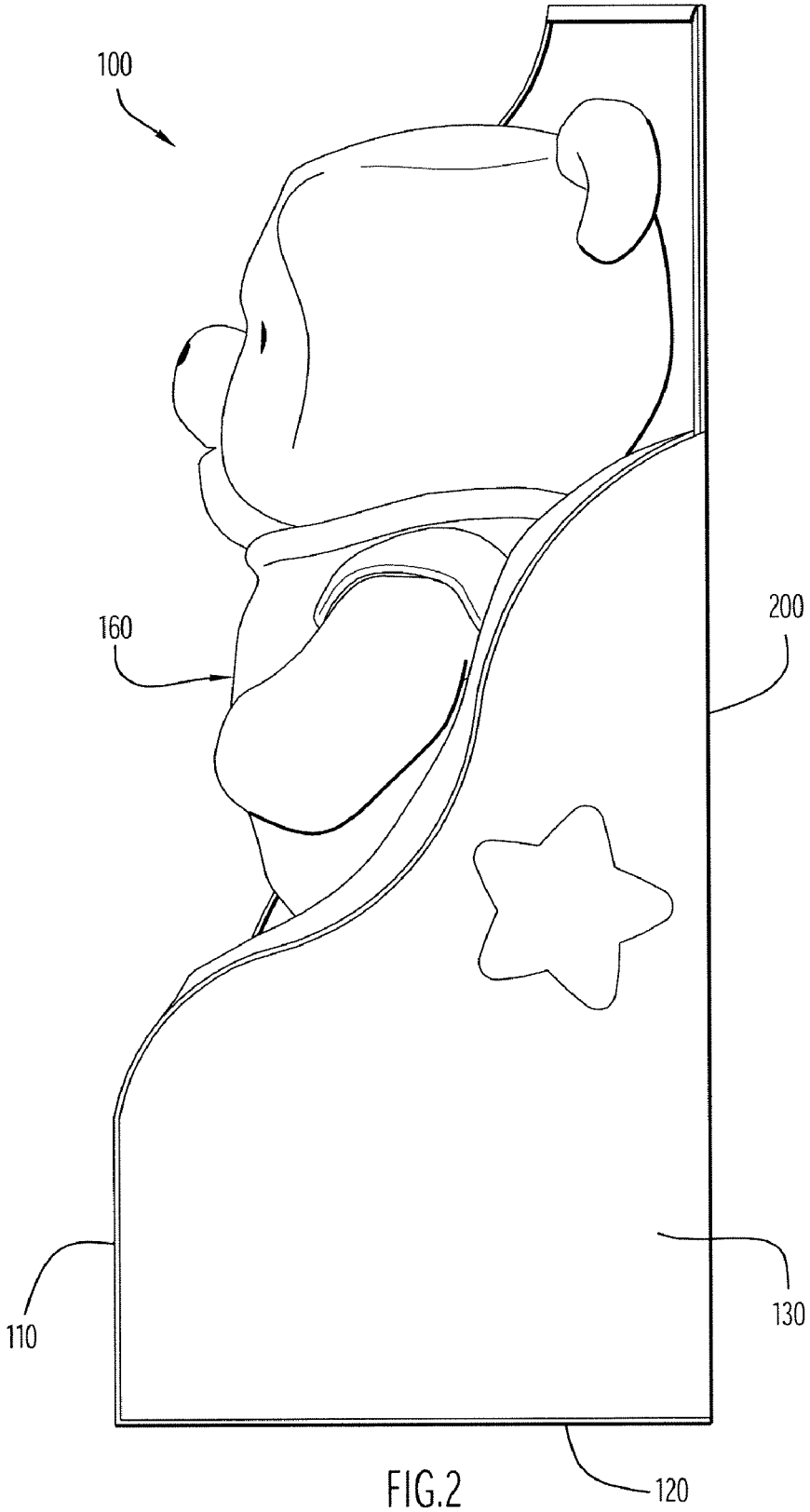
FIG. 2 illustrates a side view of the display packaging of FIG. 1.

FIG. 1 illustrates a front view of the improved display package or packaging 100 in accordance with an embodiment of the present invention. Additionally, FIG. 2 illustrates a side view of the improved display package 100 of FIG. 1. The display package 100 includes a rear package portion (identified as 200 in FIG. 2), a front package portion 110, a first side package portion 130 (also called a first side wall) extending between the rear package portion 200 and the front package portion 110, a second side package portion 140 (second side wall) extending between the rear package portion 200 and the front package portion 110, and a bottom package portion 120 extending between the rear package portion 200 and the front package portion 110 and positioned along the bottom edge of the first and second side walls 130, 140. These portions 110, 120, 130, 140, 200 define an enclosure in which a toy 160 (e.g., an animated doll or similar product) is housed. An opening 165 may be provided within the front package portion 110 to permit a user to access the toy 160. Optionally, a transparent section (not shown) may be provided over the opening 165 to permit a user to view the product 160 within the display package 100, while preventing a user from reaching into the display package 100. The toy 160 may be secured to the display package 100 proximate the rear package portion 200 using conventional fasteners. By way of specific example, the toy 160 may be secured to the rear package portion 200 by a series of tie wraps. The display package 100 and any of its components may be readily fabricated of paper board, cardboard, flake board, plastic, metal, wood, or other conventional packaging materials.

In accordance with an embodiment of the invention, a display panel 150 may be moveably mounted on the packaging 100, being positioned between the first and second side walls 130, 140, as well as between the front 110 and rear 200 package portions. Specifically, the display panel 150 may be mounted to the bottom package portion 120 and configured to move in an up and down motion, toward and away from the bottom package portion 120 (discussed in greater detail below).

Figure 3:
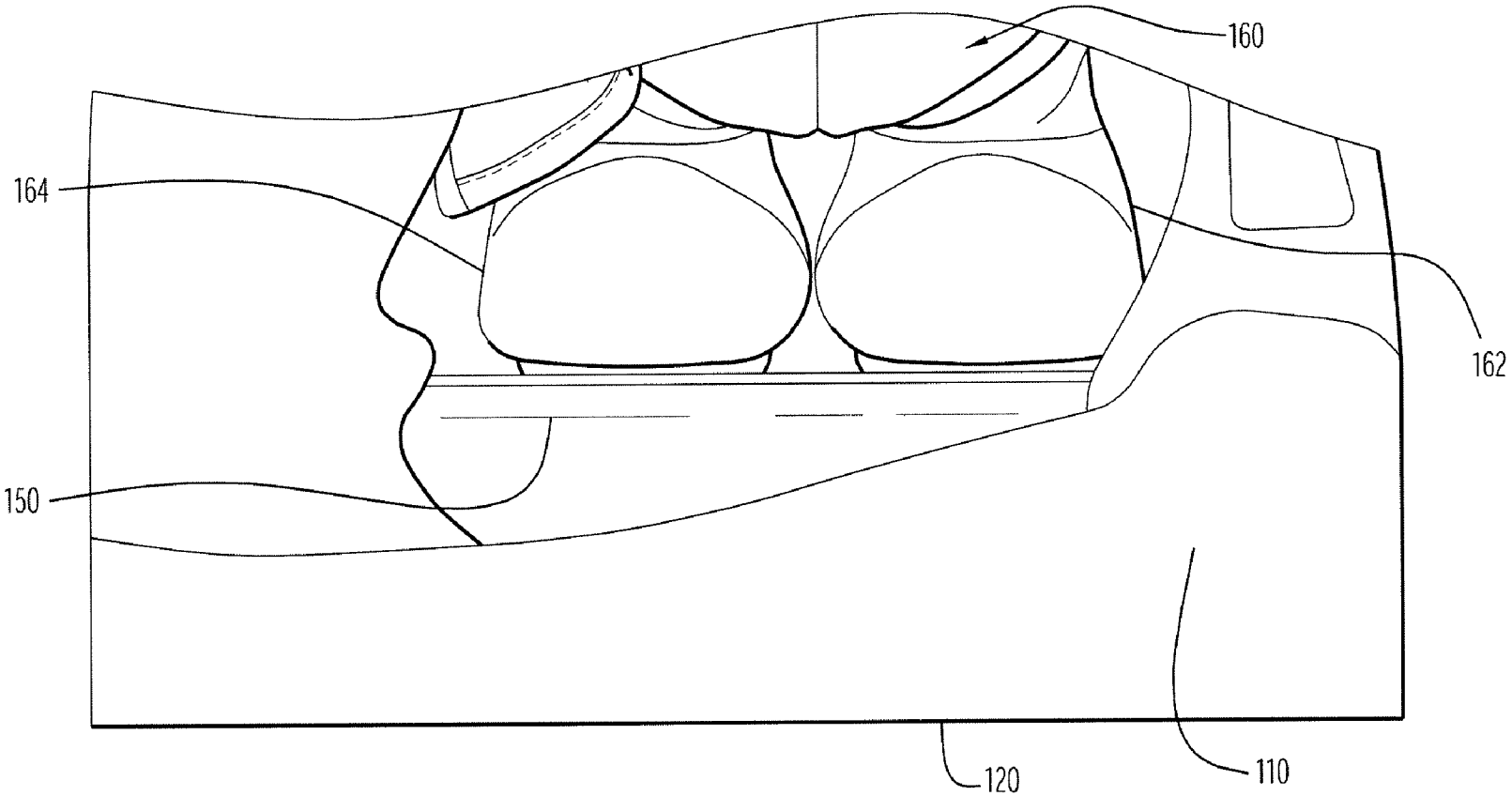
FIG. 3 illustrates a close-up front view of the lower portion of the display packaging of FIG. 1.

As discussed above, an animated toy 160 (e.g., a doll) is housed within the display package 100. The toy 160 includes at least one moveable portion animated by a drive mechanism within the toy. In the embodiment of FIG. 1, the toy 160 may include a torso 161, a first moveable portion (leg/foot) 162, and a second moveable portion (leg/foot) 164. The animation mechanism (not illustrated) repeatedly moves both the first and second portions 162, 164 from a first position to a second position and vice versa. Referring to FIG. 3, the moveable display panel 150 is shown in its upper, resting position. In this position, the first and second portions 162, 164 of the toy 160, also in their normal, resting positions, are in close proximity to the display panel 150 (i.e., in contact with or slightly above the display panel). Consequently, when the first and second portions 162, 164 move, they engage the display panel 150 such that it moves. That is, since the display panel 150 is moveably mounted to the bottom package portion 120, the movement of the first and second portions 162, 164 of the toy 160 from the first position to the second position (and vice versa) causes a corresponding movement of the display panel 150 from a first position to a second position and vice versa (discussed in greater detail below).

Figure 4:
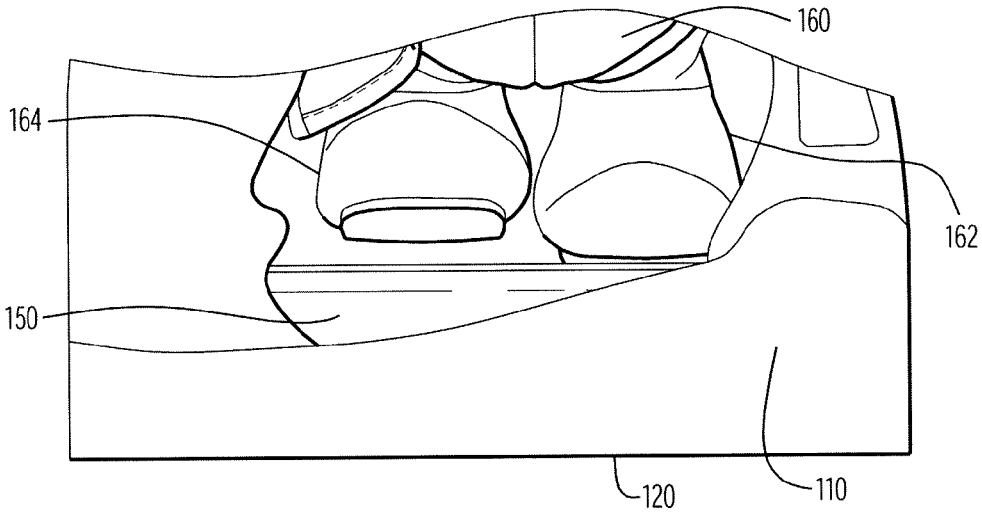
FIG. 4 illustrates a view of the lower portion of the display packaging of FIG. 3, showing a first portion of the animated doll moved from a first position to a second position.
Figure 5:
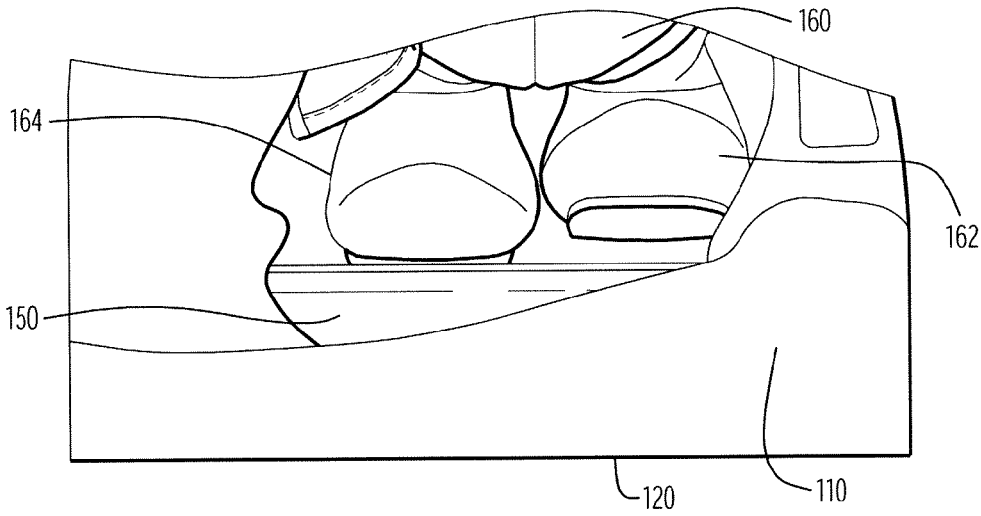
FIG. 5 illustrates a view of the lower portion of the display packaging of FIG. 3, showing a second portion of the animated doll moved from a first position to a second position.

FIGS. 4 and 5 illustrate close-up views of the lower portion of the display package 100 of FIG. 3, showing the interaction between the moveable display panel 150 and the moveable portions 162, 164 of the toy 160. Referring to FIG. 4, the first moveable portion 162 of the toy 160 has moved from a first position to a second position. Specifically, the first portion 162 has moved downward (in a walking motion) to engage the display panel 150, while the second portion 164 has moved upward, away from the display panel 150. As illustrated, the contact between the first portion 162 and the display panel 150 causes a corresponding downward movement of the display panel 150. Referring to FIG. 5, the second portion 164 of the toy 160 has similarly moved from the first position to the second position. Specifically, the second portion 164 has moved downward (in a walking motion) to engage the display panel 150, while the first portion 162 has moved upward. As with the first portion 162, the contact between the second portion 164 and the display panel 150 causes a corresponding downward movement of the display panel 150.

Figure 6:
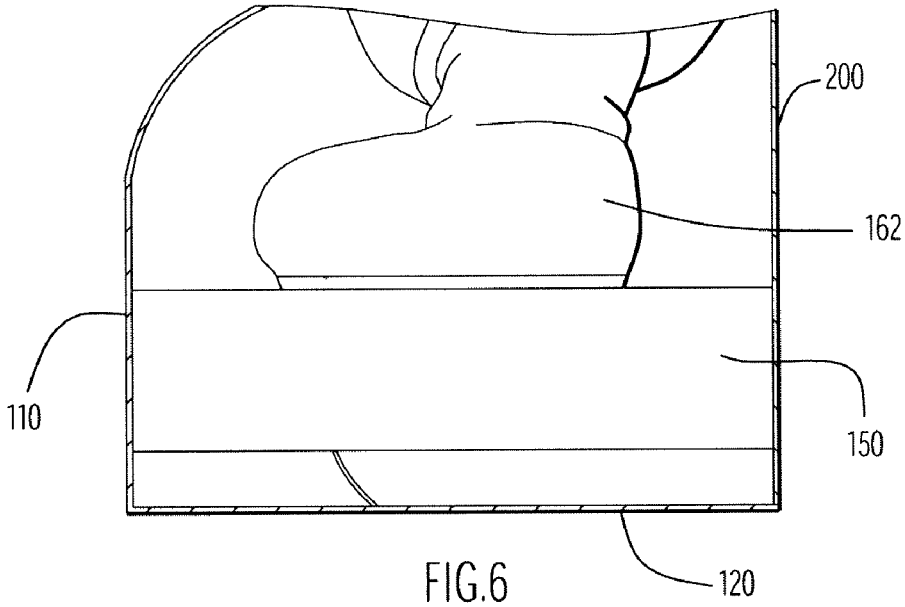
FIG. 6 illustrates an internal, side perspective view of the display packaging of FIG. 3, showing the moveable display panel in its upper/resting position.
Figure 7:
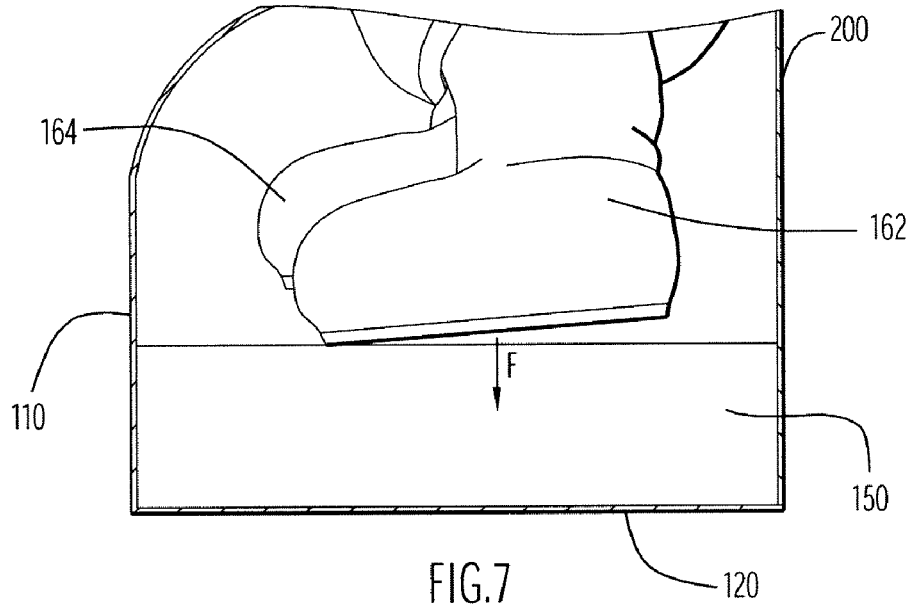
FIG. 7 illustrates an internal, side perspective view of the display packaging of FIG. 3, showing the moveable display panel in its lower/engaged position.

FIGS. 6-8 illustrate side views of the display package 100 of FIG. 1 (where the first side wall 130 of the display package 100 has been removed for clarity). In FIG. 6, the moveable display panel 150, the first portion 162, and the second portion 164 are shown in their resting positions. As illustrated, when the display panel 150 is in its upper, resting position, it is spaced above the bottom package portion 120. Referring to FIG. 7, when one of the moveable portions 162, 164 of the toy 160 is driven downward, it engages the display panel 150, urging it to move to its lower, engaged position. In operation of the toy 160 (while it is housed within in the display package 100), the repeated upward and downward movements of the first and second portions 162, 164 of the toy 160 cause a corresponding upward and downward movement of the display panel 150.

Figure 8A:
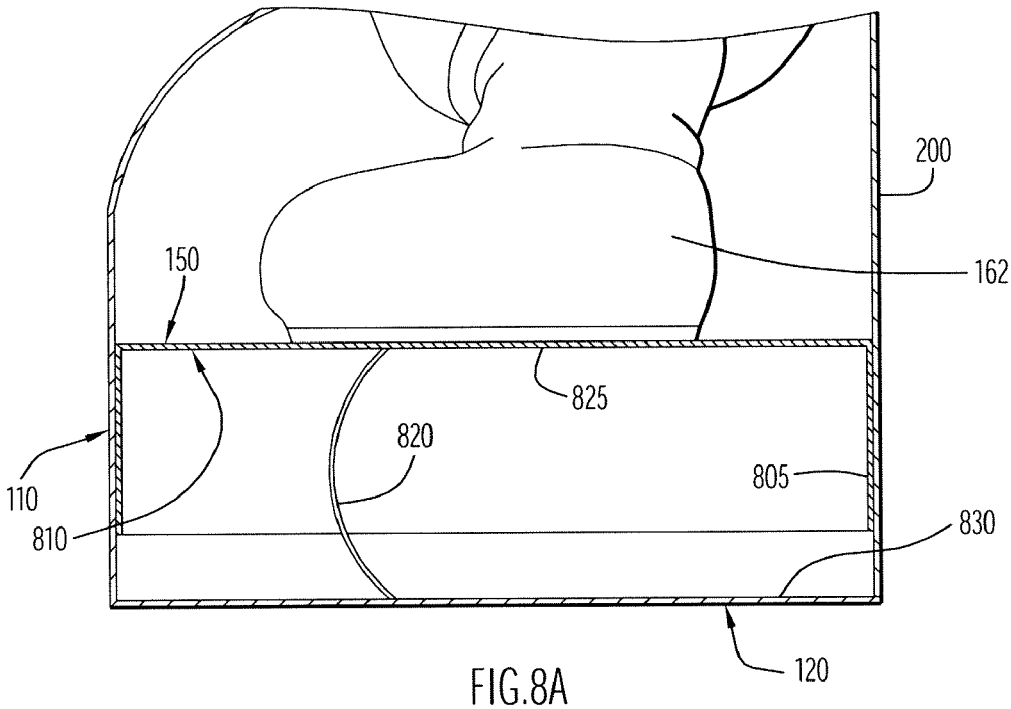
FIG. 8A illustrates a side view of the display packaging of FIG. 6, showing the interaction between the biasing member, the moveable display panel, and the bottom packaging portion when the moveable display panel in its upper, resting position.
Figure 8B:
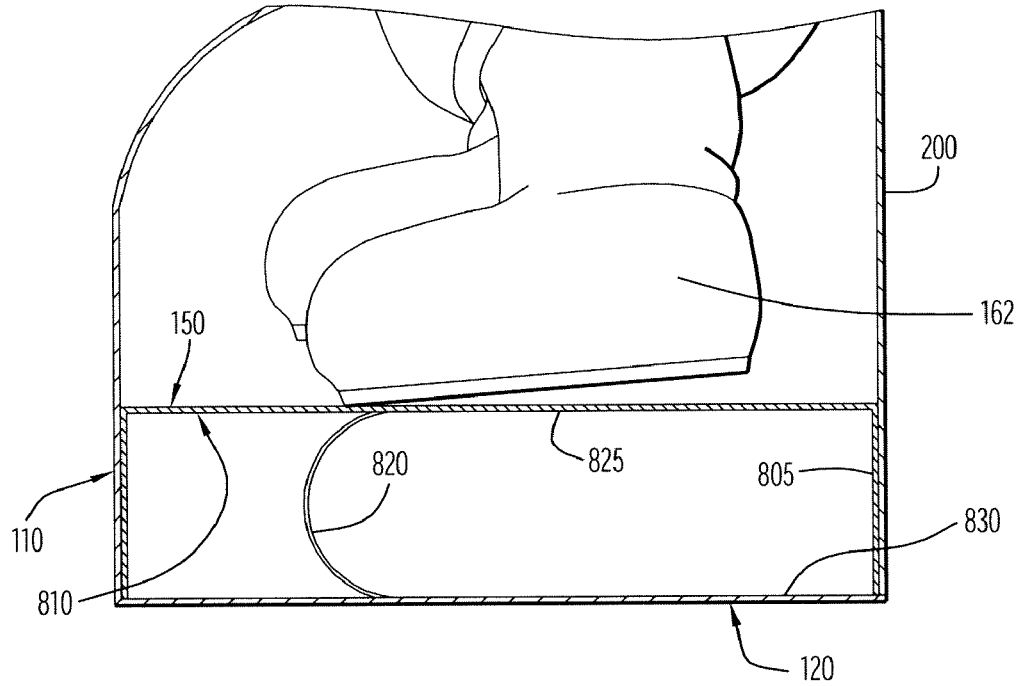
FIG. 8B illustrates a side view of the display packaging of FIG. 7, showing the interaction between the biasing member, the moveable display panel, and the bottom packaging portion when the moveable display panel in its lower, engaged position.

Between these upward and downward movements of the first and second portions 162, 164 of the toy 160, the display panel 150 assumes its upper, resting position (as shown in FIGS. 1, 3, and 6). The moveable display panel 150 may be urged into its upper, resting position by, for example, a biasing member. FIGS. 8A and 8B illustrate the display package 100 of FIGS. 6 and 7, respectively, showing an interior view of the lower package portion (a side wall of the display panel 150 has further been removed for clarity). In the embodiment shown, the moveable display panel 150 includes generally vertical side walls 805 and a generally horizontal top (support) wall 810 extending between the side walls 805. A biasing member 820 is interposed between the top wall 810 of the display panel 150 and the bottom package portion 120. One end of the biasing member 820 is attached to the inner surface 825 of the top wall 810 of the display panel 150 and the other end of the biasing member 820 is attached to the inner surface 830 of the bottom package portion 120. The biasing member 820 may comprise, but is not limited to, an elongated strip of resiliently flexible material, e.g., PVA or acetate. Alternatively, a spring may be used.

The biasing member 820 is resilient—it possesses strength sufficient to impart an upward force to the moveable display panel 150 and support the display panel 150 in its upper, resting position, but is flexible such that it may be depressed from an elongated state to a compressed state. Referring to FIG. 8A, when the first and second portions 162, 164 of the toy 160 are in their first (resting) positions, the biasing member 820 is in its elongated state, supporting the moveable display panel 150 in its upper, resting position. As the first/second portions 162, 164 of the toy 160 are driven from their respective first positions to their respective second positions, however, the resulting force moves the display panel 150 from its upper, resting position to its lower, engaged position, compressing the biasing member 820 (FIG. 8B). When the first/second portions 162, 164 of the toy 160 return to their respective first (resting) positions, the force is removed, and the biasing member 820 returns to its elongated state (FIG. 8A), pushing the display panel 150 back to its upper, resting position.

With the above described configuration, the repeated upward and downward movement of the first and second portions 162, 164 of the toy 160 causes a repeating, upward and downward movement of the display panel 150, which highlights the animation features of the toy 160 within the display packaging 100. In operation, the downward movement of the display panel 150 is caused by the downward force imparted by the first and second portions 162, 164 of the toy 160 engaging the display panel 150 (i.e., by the first and second portions 162, 164 moving from their respective first positions to their respective second positions). This force overcomes the upward bias of the biasing member 820, driving the display panel 150 toward the inner surface 830 of the bottom portion 120 and placing the display panel 150 in its lower, engaged position. Once the first and second portions 162, 164 of the toy 160 return to their respective first positions, the biasing member 820 returns to its elongated state, driving the display panel 150 upward to its upper, resting position. This process repeats itself as long as the motion features of the toy 160 are activated while the toy is housed in the packaging 100. This up and down movement of the display panel 150, which is visible through the front package portion 110 (seen best in FIGS. 4 and 5), facilitates an in-package demonstration of the movement of the first and second portions 162, 164 of the toy 160.

Figure 9:
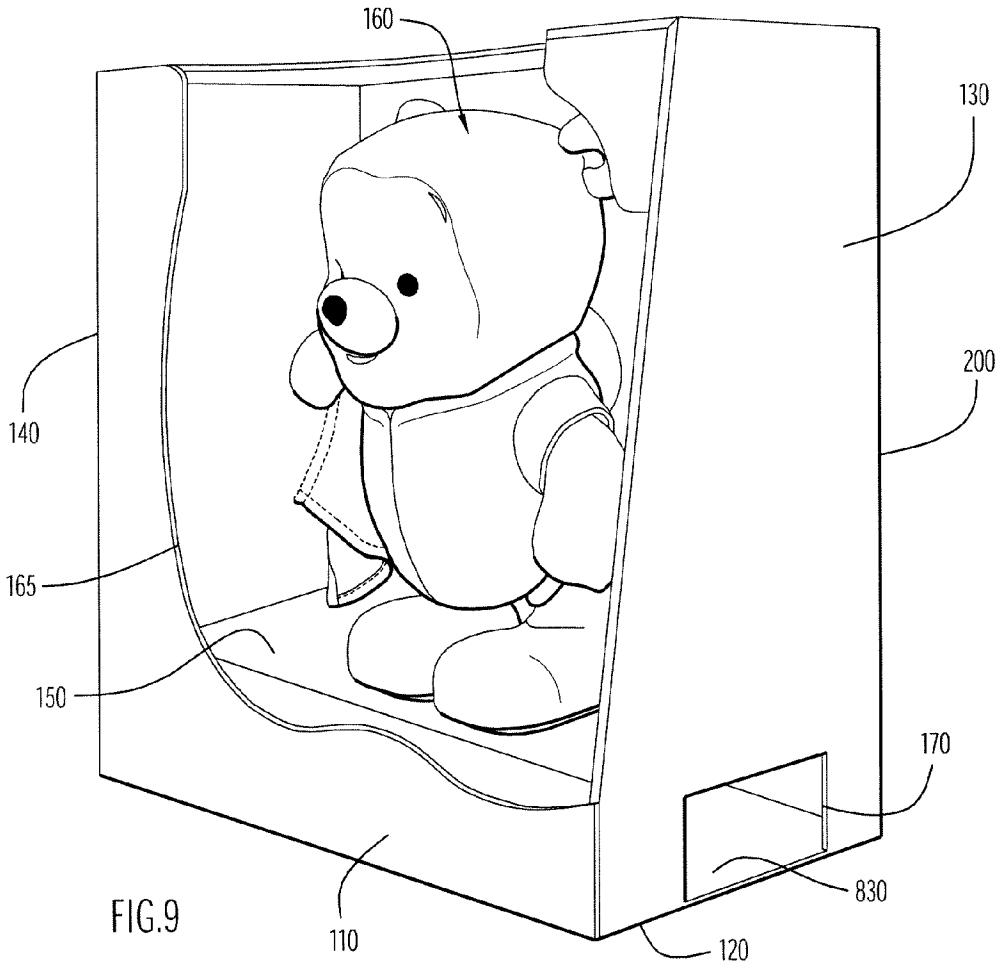
FIG. 9 illustrates a perspective view of the display packaging according to another embodiment of the invention, wherein the display packaging is adapted to couple with a packaging attachment.

In another embodiment of the invention, the improved display package 100 may include an attachment operable to secure and protect the product 160 within the packaging 100, and/or to immobilize the moveable display panel 150 in its upper, resting position. FIG. 9 illustrates a display package 100 having a structure similar to that described above, including a front package portion 110 with an opening 165, a bottom package portion 120, a first side portion 130, a second side portion 140, a display panel 150, and a rear package portion 200. The display package 100, however, has been adapted to receive a packaging attachment (not shown in FIG. 9, referenced as 300 in FIG. 10). As shown in FIG. 9, the display package 100 includes a receptacle/opening 170 located along the first side package portion 130. The receptacle 170 defines a channel extending between the top wall 810 of the display panel 150 and the inner surface 830 of the bottom package portion 120. The receptacle 170 may comprise a channel extending partially through the display package 100 and/or the display panel 150. Alternatively, the channel may extend completely through the display package 100 and/or the display panel 150, extending from the first side portion 130 to the second side portion 140. In an alternative embodiment, the opening of the receptacle 170 may be located in the second side portion 140 (not shown).

Figure 10:
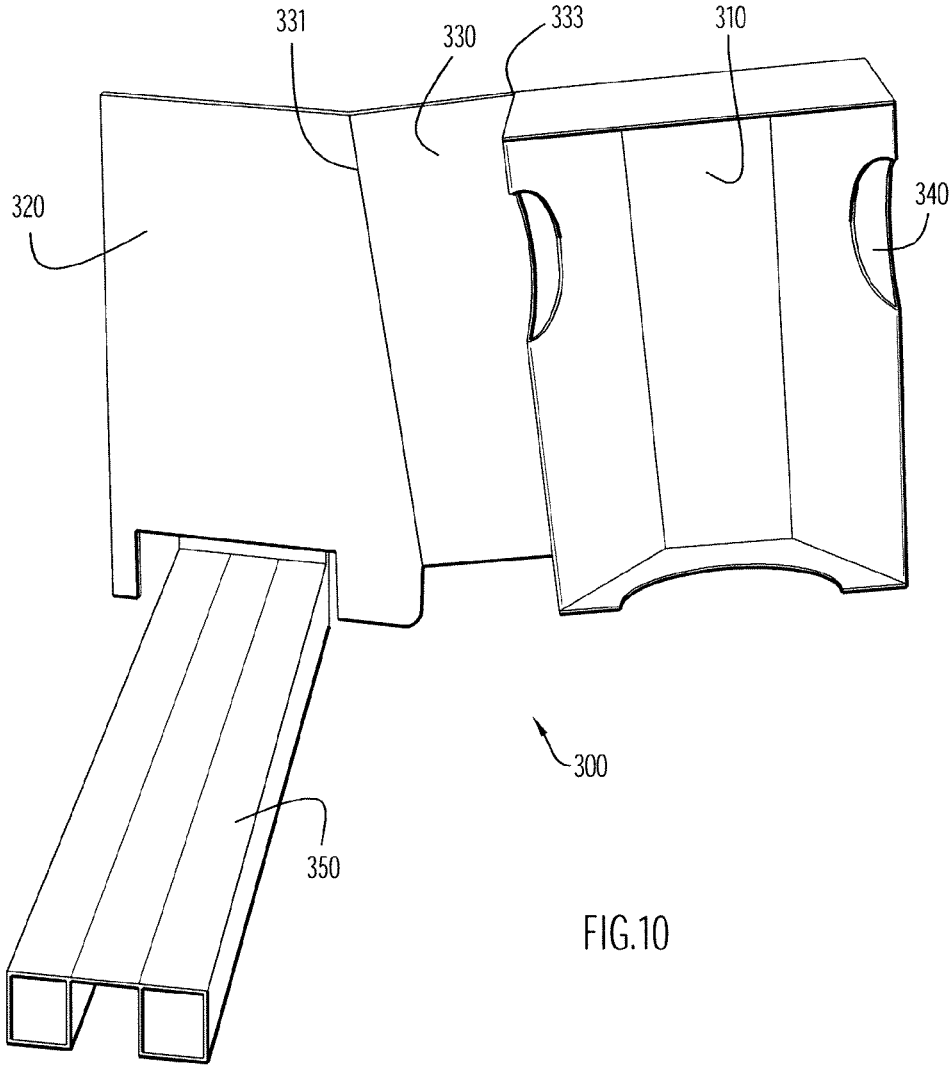
FIG. 10 illustrates a perspective view of a packaging attachment according to an embodiment of the invention.

The packaging attachment 300 (also called a stabilizer) comprises a structure configured to secure the display panel 150 in its upper, resting position and/or to protect the toy 160 housed in the display package 100. When inserted into the receptacle 170, the packaging attachment 300 also provides structural support to the moveable display panel 150, allowing it to bear greater loads. FIG. 10 is a perspective view of the packaging attachment 300 according to an embodiment of the present invention. As shown, the packaging attachment 300 includes a cover or hold-down section 310 (also called a plate) and a package- or receptacle-engaging section 320. The cover plate 310 is joined to the package-engaging section 320 via a connector 330 with fold lines 331, 333. The materials comprising the packaging attachment 300 are not limited, and include paper board, cardboard, flake board, plastic, metal, wood, or other conventional packaging materials.

The cover plate 310 includes a structure adapted to shield the toy 160 from undesired contact and/or secure it from movement (e.g., contact or movement that may occur during shipping). Specifically, the cover plate 310 may include a structure that fits substantially within the opening 165 of the display package 100 and at least partially covers the toy 160 and/or the package opening 165. Preferably, the cover plate 310 is inserted through the opening 165 to engage the toy 160. The cover plate 310 may further comprise one or more contoured portions 340 configured to mate with one or more portions of the toy 160. By way of specific example, and as shown in FIG. 10, the contoured portions 340 may comprise semicircular cut-out sections positioned and sized to engage each arm of the toy 160. Alternatively, the contoured portions 340 may correspond to other portions of the toy 160 including, but not limited to, the toy's legs, head, neck, and/or torso. When placed within the opening 165 of the display package 100 and over the toy 160, the cover plate 310 shields the toy 160, as well as secures the toy 160 within the display package 100 by capturing portions of the toy 160 (via the contoured portions 340).

The package-engaging section 320 comprises a structure configured to couple the packaging attachment 300 to the display package 100 and/or to substantially immobilize the moveable display panel 150. Referring to FIG. 10, the package-engaging section 320 includes an insert or extension member 350 that protrudes horizontally from the bottom of the package engaging section 320. The insert 350 comprises a structure that supports the moveable display panel 150 in its upper, resting position. By way of example, the insert 350 may comprise a single bar contoured to slidably engage the receptacle 170 (i.e., the insert 350 may have dimensions slightly smaller than those of the receptacle 170). Alternatively, as illustrated in the embodiment of FIG. 10, the insert 350 may comprise two connected, spaced apart bar portions. When inserted into the receptacle 170, the insert 350 effectively braces the display panel 150, preventing the downward movement of the display panel 150 toward the bottom package portion 120. Alternatively, the insert 350 may secure the display panel 150 in its lower, engaged position (not illustrated). The material comprising the insert 350 is not limited, and may include any resilient and/or substantially rigid material such as plastic (e.g., PVA or acetate) or cardboard. The insert 350 may extend partially or completely into the receptacle 170. For example, the insert 350 may extend partially into the receptacle 170, just short of the biasing member (not shown). Alternatively, the insert 350 may be configured to extend around the biasing member 820 (e.g., comprise two spaced apart bars that extend around the biasing member), or the biasing member 820 may be positioned within the display package 100 to accommodate the insert 350.

Figure 11:
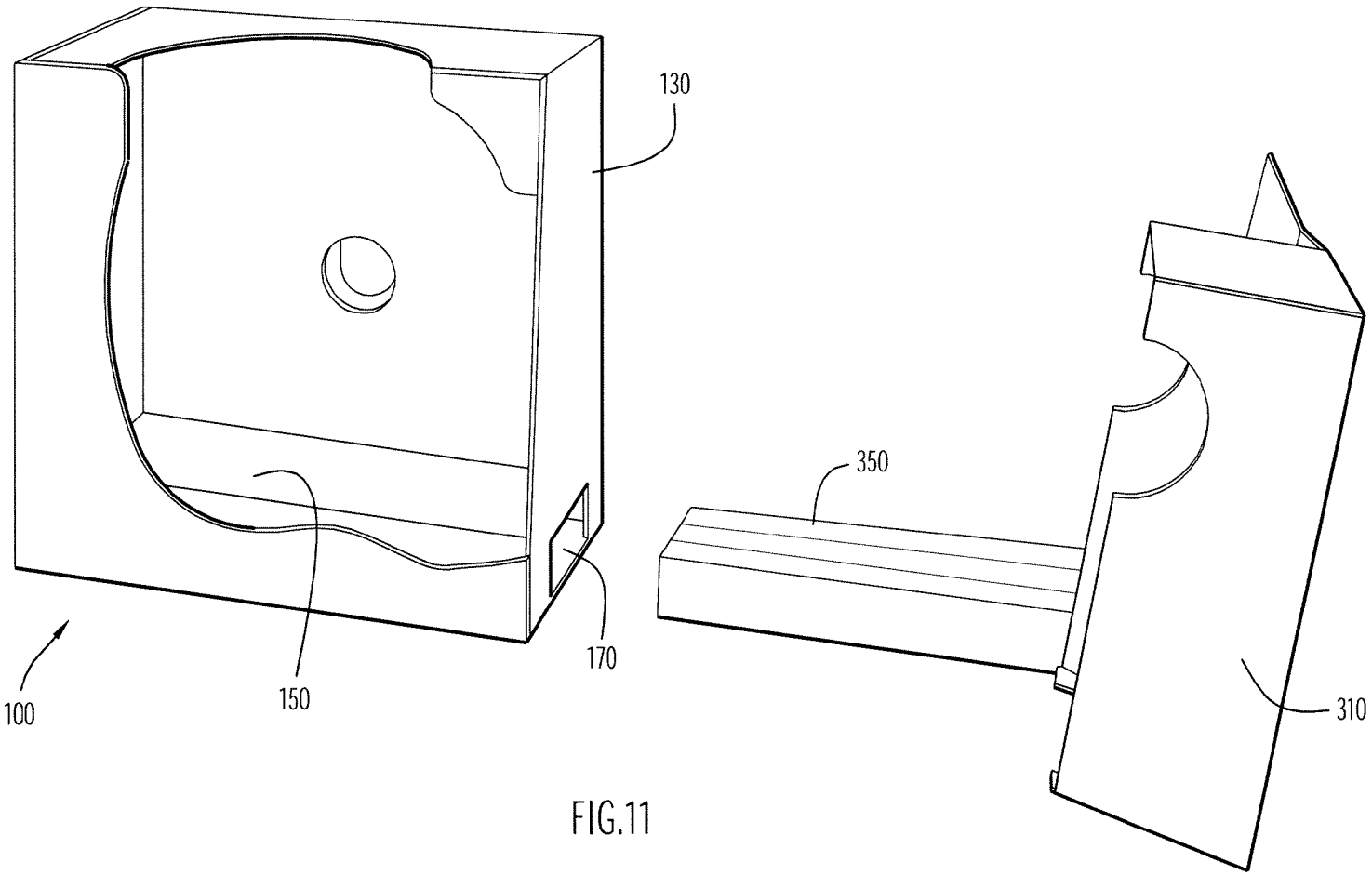
FIGS. 11, 12, and 13 illustrate perspective views of the packaging attachment of FIG. 10 and the display packaging of FIG. 9, showing the coupling of the packaging attachment to the display packaging.
Figure 12:
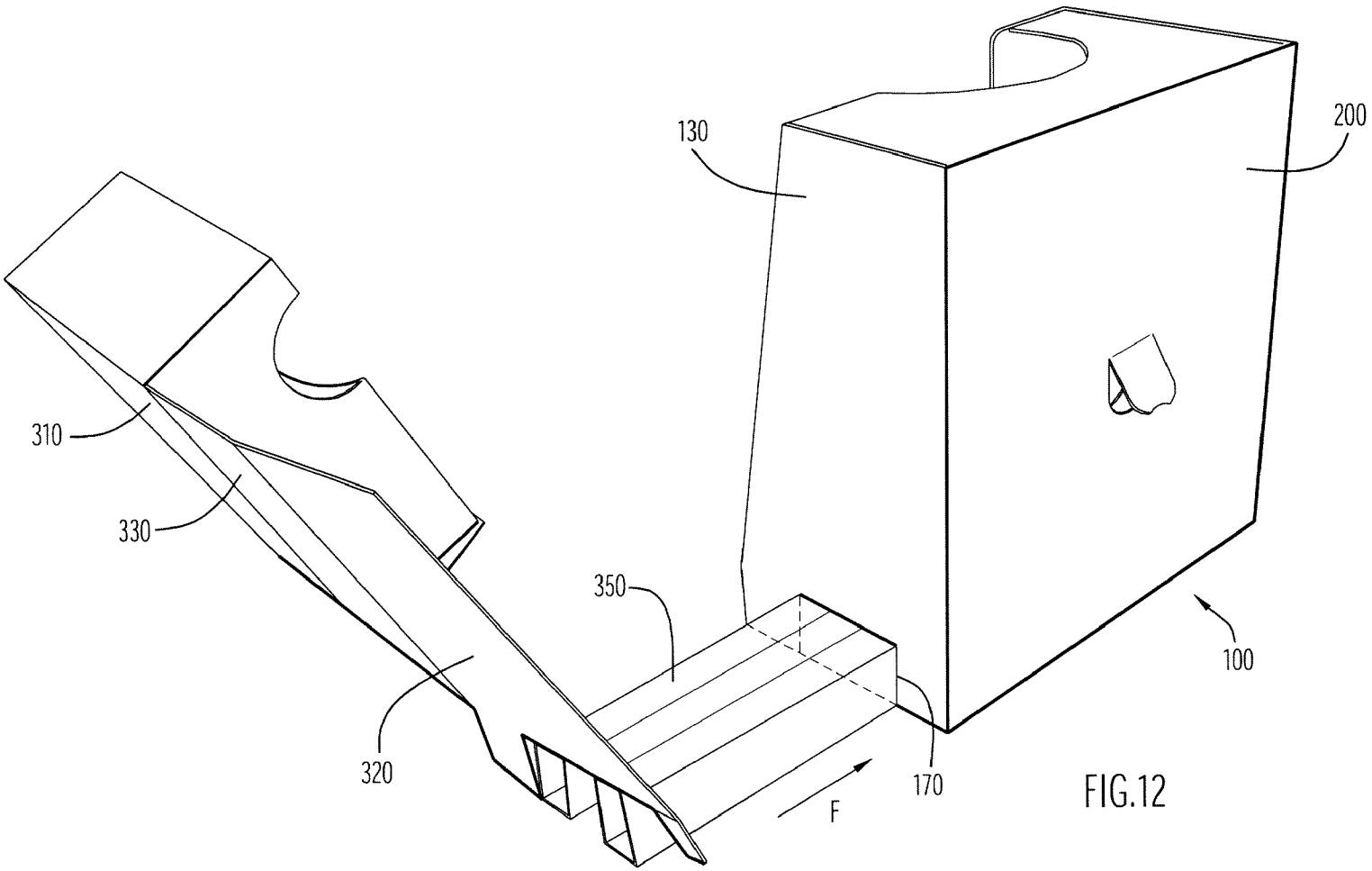
Figure 13:
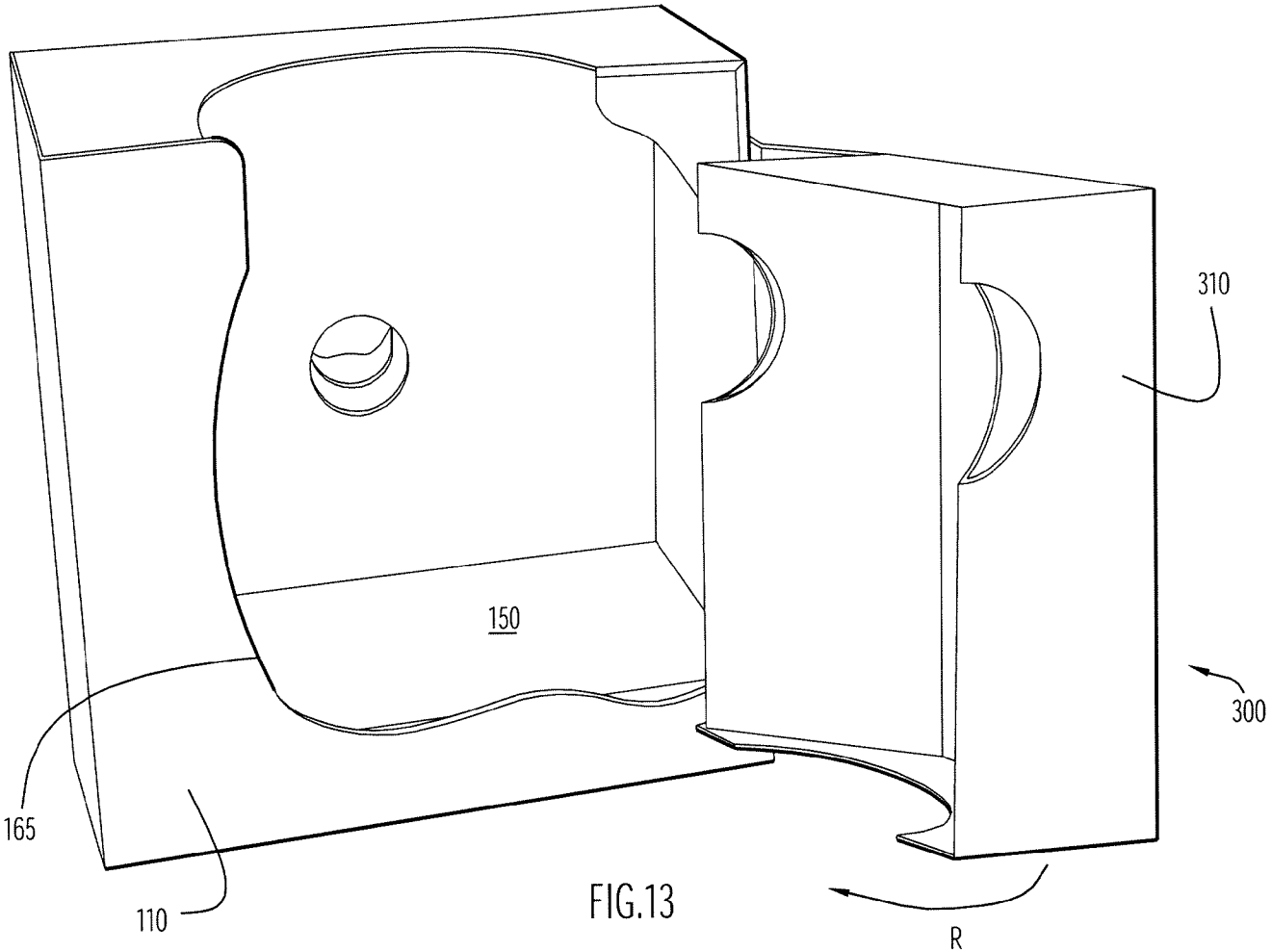
Figure 14A:
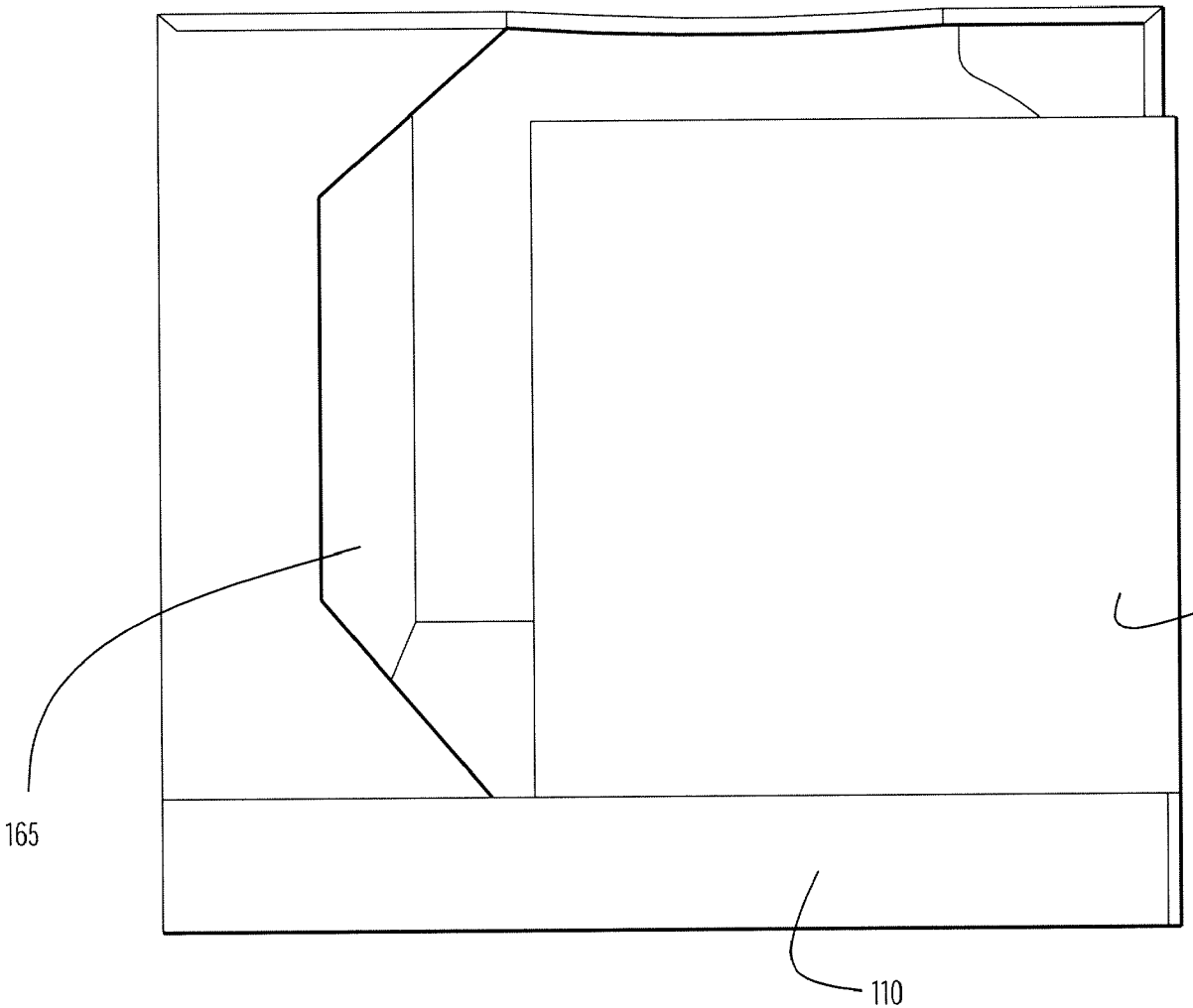
FIG. 14A illustrates a front view of the display packaging of FIG. 9 with the packaging attachment of FIG. 10 connected thereto.
Figure 14B:
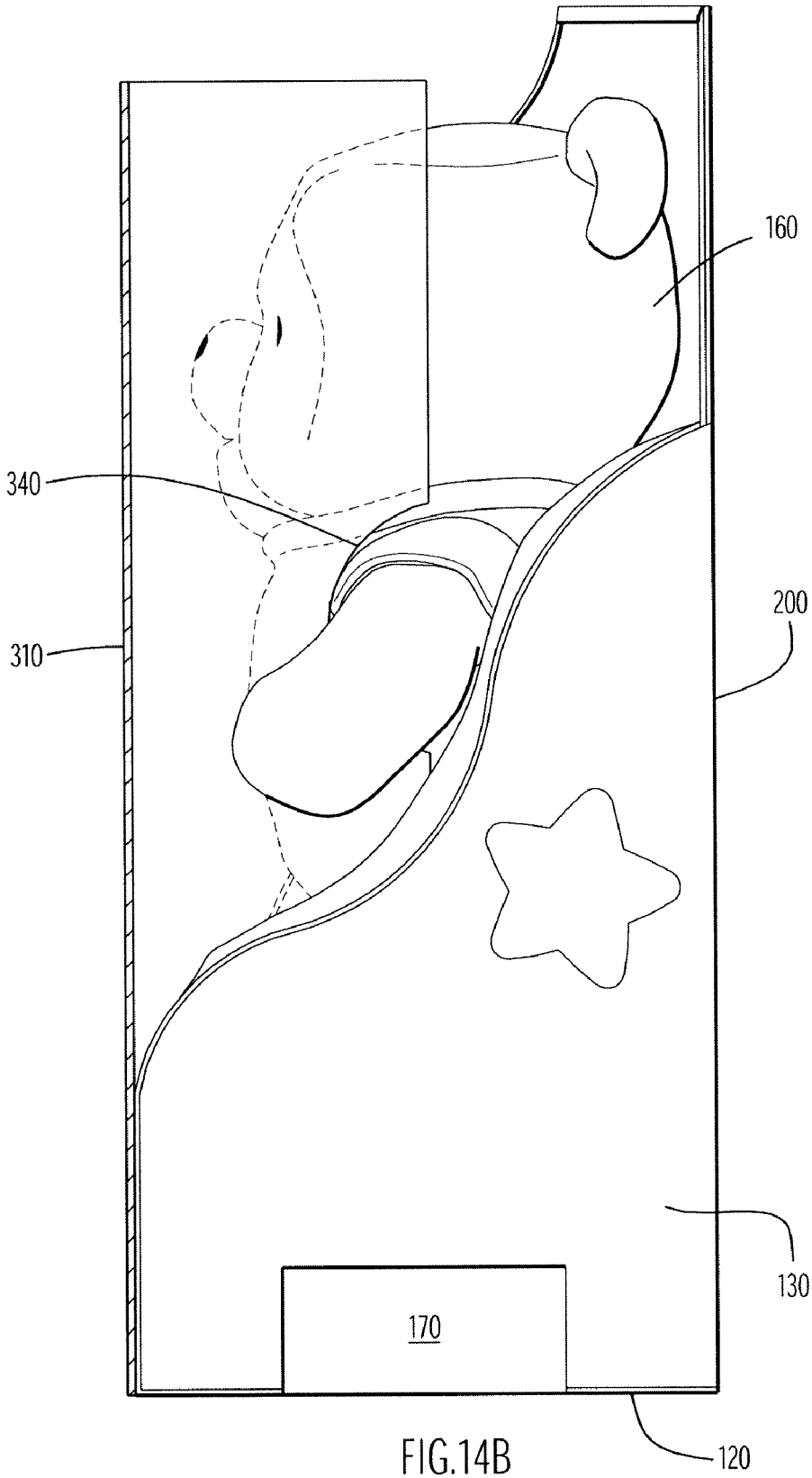
FIG. 14B illustrates an internal, side view of the display packaging of FIG. 14A, showing the interaction between the toy and the packaging attachment.

FIGS. 11, 12, 13, 14A, and 14B illustrate the connection of the packaging attachment 300 to the display package 100. Referring to FIG. 11, the insert 350 is aligned with the opening of the package receptacle 170 and, as shown in FIG. 12, a force (indicated by arrow F) is applied to axially urge the insert 350 into the receptacle 170. The insert 350 may be urged into the receptacle 170 until the package-engaging section 320 contacts the first side portion 130 of the display package 100. Referring to FIG. 13, once inserted, the cover plate 310 is folded inward (toward the front portion 110 of the display package 100, as indicated by arrow R) via the fold lines 331, 333. Finally, the cover plate 310 is positioned within the opening 165 of the display package 100 (FIG. 14A) and over the toy 160, at least partially or completely covering the toy 160 located within the display package 100 (see FIG. 14B, where package-engaging section 320 is not shown for clarity).

When the insert 350 is inserted into the receptacle 170, the moveable display panel 150 is biased in its upper, resting position, with the display panel 150 immobilized and its downward movement prevented. That is, the moveable display panel 150 is immobilized since the insert 350 generally prevents the movement of the display panel 150 from its upper, resting position to its lower, engaged position (as described above). In addition, once the cover plate 310 is placed over the toy 160, contact with the toy 160 through the opening 165 is prevented by the cover plate 310, thus protecting the toy 160. This is particularly useful when the display package 100 is shipped, e.g., to a point of sale (e.g., a retail store). During shipment, since the display package 100 includes an opening 165 along its front portion 110, the toy 160 is susceptible to unwanted contact that may damage the toy 160. In addition, jostling that typically occurs during shipping may cause the toy 160 to repeatedly engage the display panel 150 with uncontrolled force, potentially damaging the display panel 150 or the biasing member 820, minimizing its biasing capability. Use of the packaging attachment 300 prevents such damage not only by covering the opening 165 of the display package 100, but also by immobilizing the toy 160 and the display panel 150.

Once the display package 100 reaches its destination (e.g., the point of sale), the reverse of the above process is followed, with the cover plate section 310 being folded outward (away) from package front portion 110 and the insert 350 being axially removed from the receptacle 170, enabling access to the toy 160 and permitting the display panel 150 to move from its first position to its second position, which, in turn, highlights the animation features of the toy 160.

Figure 15:
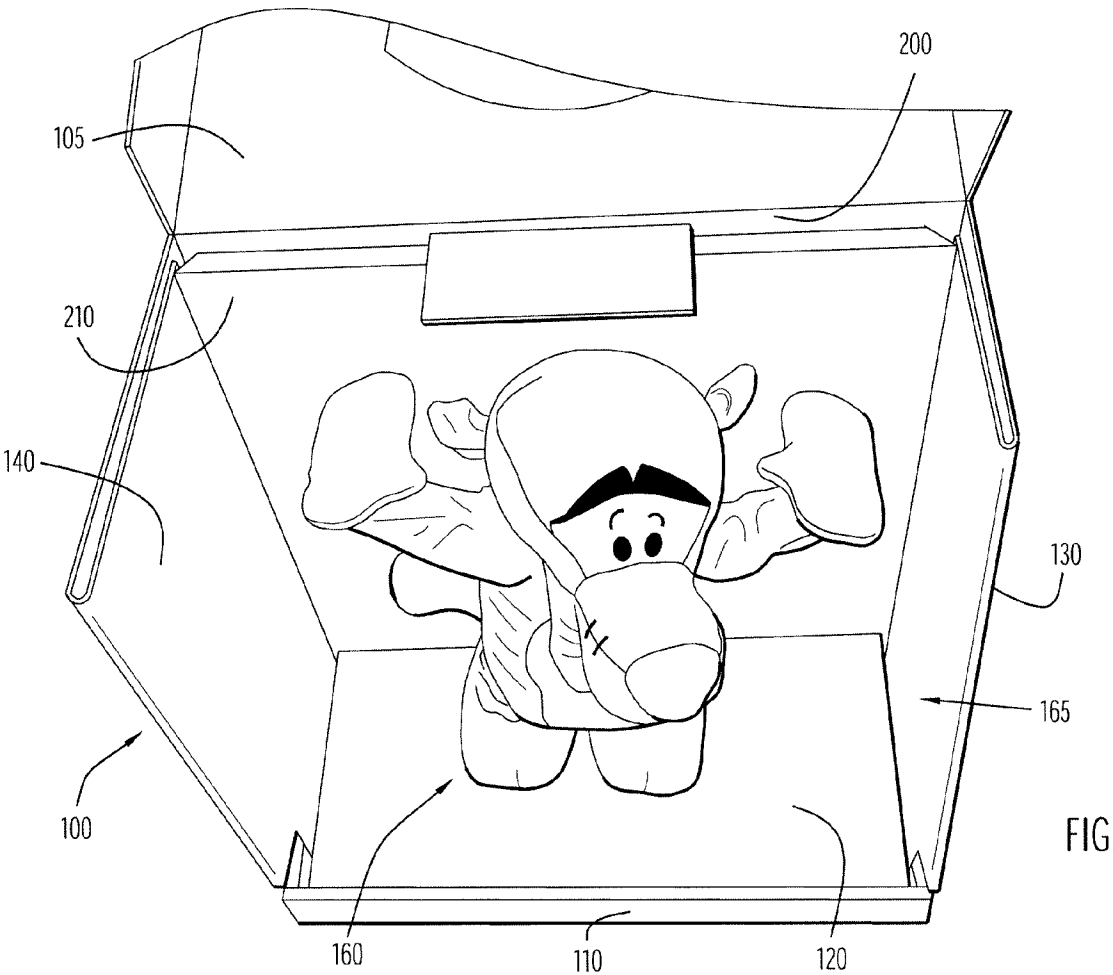
FIG. 15 illustrates a top, internal view of the display packaging in accordance with another embodiment of the present invention.

The display package 100 may be further adapted to highlight additional, full figure movements of the toy 160 within the display package 100. Specifically, the display package 100 may be adapted to permit the spinning or pivoting of the toy 160 within the display package 100. FIG. 15 is a top perspective view of the display package 100 according another embodiment of the invention (with a top portion 105 folded away for clarity). The display package 100 is similar to that described above in connection with FIGS. 1-14, comprising an enclosure including a front package portion 110 with an opening 165, a bottom package portion 120, a first side package portion 130, a second side package portion 140, and a rear package portion 200. In the embodiment illustrated, the display panel 150 and biasing member 820 described above has been omitted; however, it may be provided, if desired. An animated doll or similar toy product 160 is housed within the display package 100. The display package 100 may further include a backing 210 operable to support the toy 160 and couple it to the rear portion 200 of the display package 100.

Figure 16:
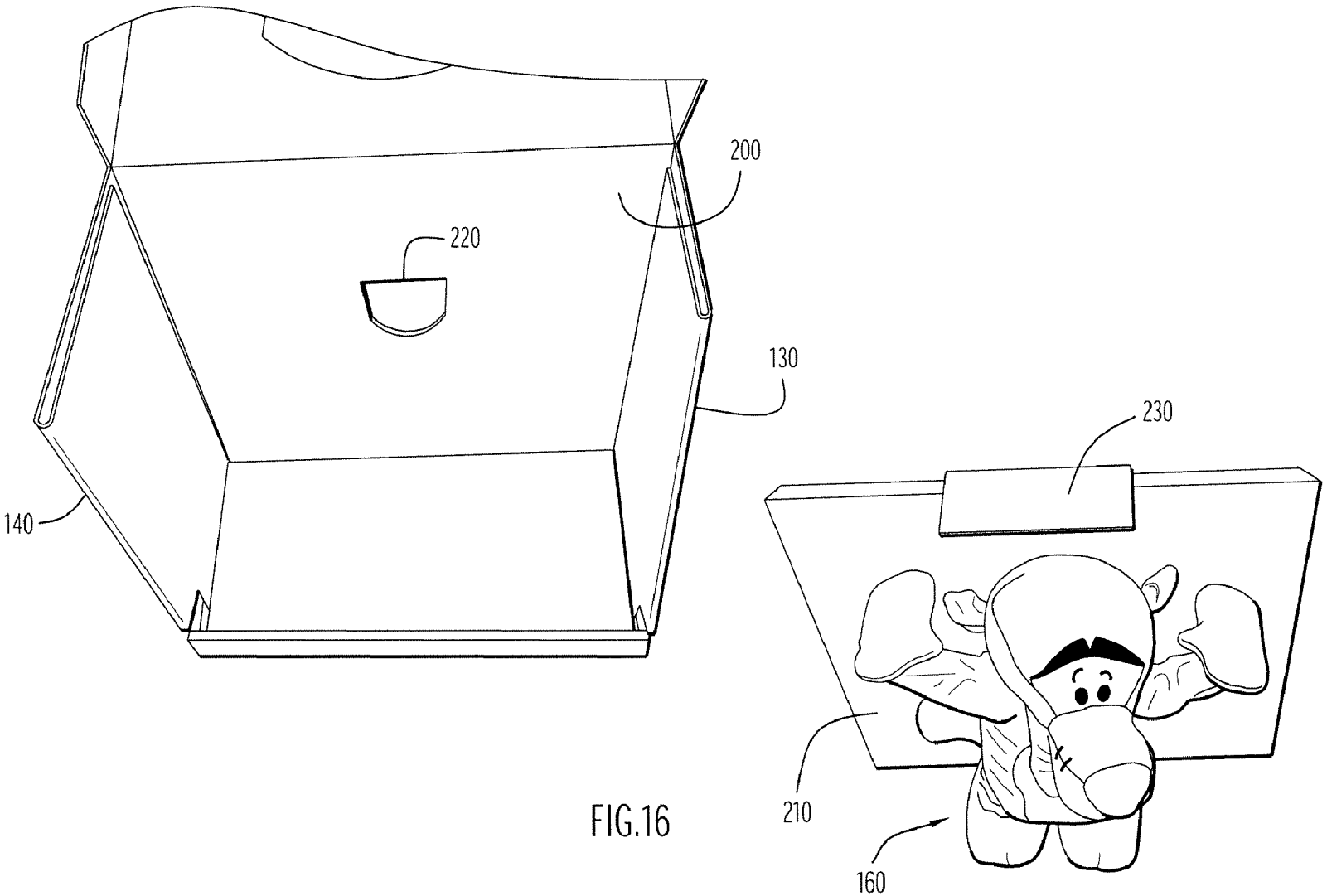
FIG. 16 illustrates a top perspective view of the display packaging of FIG. 15, showing the backing separated from the rear portion of the display packaging.

FIG. 16 is a top perspective view of the display package 100 of FIG. 15, showing the backing 210 separated from rear package portion 200. As illustrated, the rear package portion 200 may include an aperture 220 configured to permit a user access to the interior of the packaging and, in particular, to the backing 210. The backing 210 may connect to the rear portion 200 using conventional means (adhesives, tabs and slots, friction fit, tie wraps etc.). The backing 210 may further include a support member 230 running the entire height of the backing 210. The support member 230 may connect to the backing 210 using conventional means (adhesives, tabs and slots, friction fit, tie wraps etc.).

Figure 17:
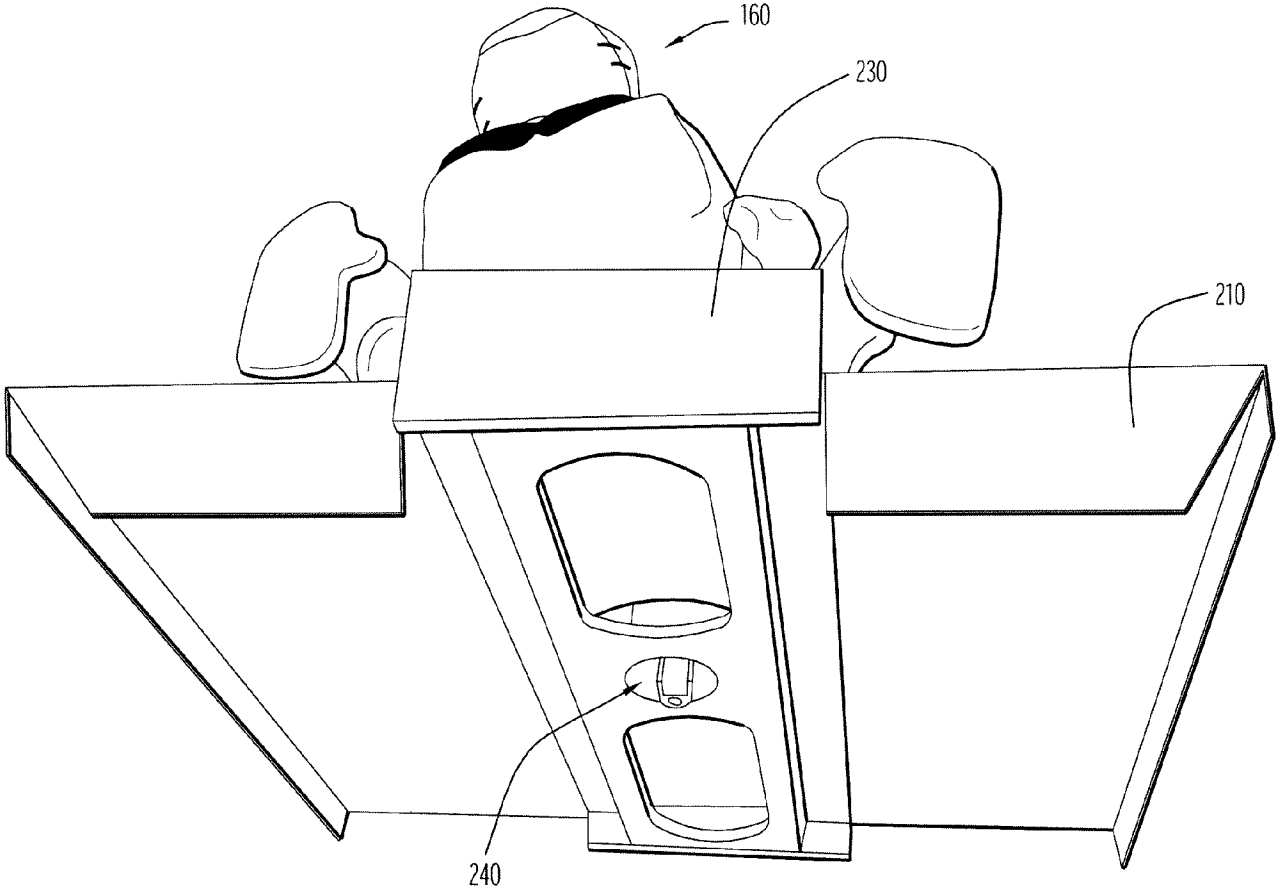
FIG. 17 illustrates a rear perspective view of the backing of FIG. 16, showing the support member.
Figure 18:
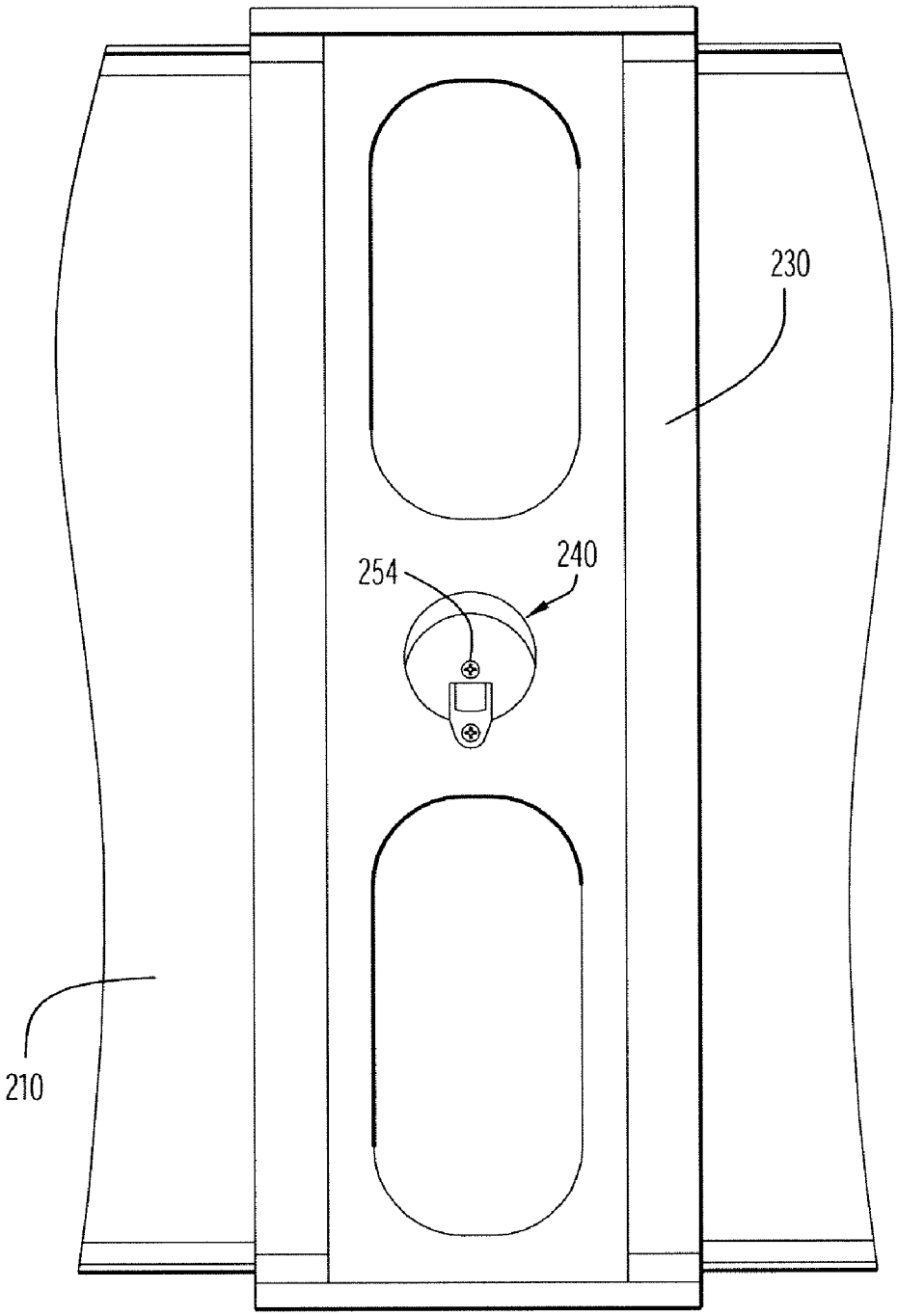
FIG. 18 illustrates a rear close-up view of the support member of FIG. 17.

The support member 230 is utilized to support the toy 160 within the display package 100. FIGS. 17 and 18 are rear perspective views of the backing 210, showing the support member 230 attached to the rear side of the backing 210 (and the toy 160 attached to the front side). As shown, the support member 230 may comprise a generally I-shaped beam coupled to the backing 210 proximate its longitudinal centerline. The materials comprising the support member 230 are not limited, and may include substantially rigid materials such plastic, corrugated cardboard, etc. The rear side of the support member 230 (the side closer to the viewer in FIGS. 17 and 18) may include a cavity 240 formed by a post (referenced as 260 in FIG. 19) that extends outward from the front of the support member 230 (seen best in FIG. 19 and discussed in greater detail below).

The display package 100 may further include a fastener operable to secure the toy 160 to the support member 230 and, specifically, to the post 260. Referring to FIG. 18, a removable fastener 254 such as a screw is connected to the support member 230. The fastener 254 extends through the post 260 and engages to the toy 160. For example, it may fasten to the animation mechanism of the toy 160 (not illustrated). The type of fastener 254 is not limited so long as it functions to secure the toy 160 to the post 260 (e.g., screws, etc.). With this configuration, the toy 160 may be removably secured to the support member 230, allowing a user to remove the toy 160 and support member 230 from the display package 100.

Figure 19:
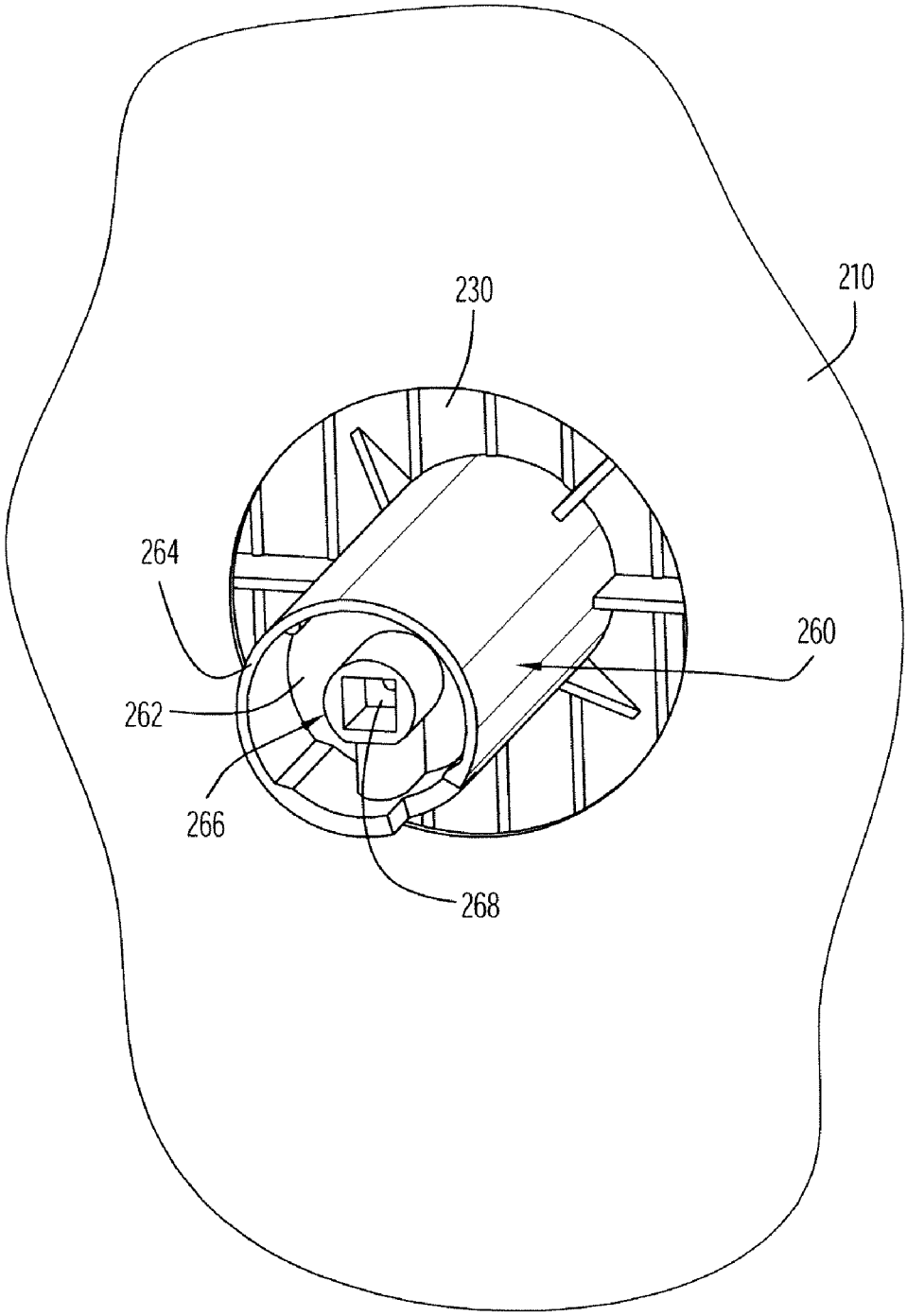
FIG. 19 illustrates a front close-up view of the backing of FIGS. 16-18, showing the support post.

The post 260 extends from the front surface of the support member 230 and toward the toy 160. The post 260 is configured to permit the movement of the toy 160 about the post 260. The size and shape of the post 260 is not limited, and may be altered to accommodate the toy's size, the desired degree of rotation, etc. FIG. 19 is a front, close-up view of the backing 210 of FIGS. 17 and 18, showing the configuration of the post 260. In the embodiment illustrated in FIG. 19, the post 160 comprises a generally cylindrical bar extending horizontally from the support member 230. The post 260 extends through the backing 210 and into the toy 160 (seen best in FIG. 20). The post 260 enters the toy 160 through a receptacle located in the body of the toy 160 (not shown). The receptacle in the toy 160 may be covered by a spring-loaded door that permits the insertion of the post 260 into the toy 160, but closes upon its removal. The toy receptacle provides access to the internal drive mechanism of the toy 160, which facilitates the movement of the toy 160 within the display package 100.

The end of the post 260 may be keyed to engage the animation mechanism of the toy 160. In the embodiment of FIG. 19, the end of the post 260 includes an inset area 262 that creates and generally annular flange 264 about the periphery of the post. Located proximate the center of the inset area 262 is a protrusion or boss 266 with a socket 268 contoured to couple with the head of the toy's drive mechanism (the drive mechanism is not illustrated). The contour of the socket 268 is not limited, and may include square shapes, hexagonal shapes, etc.

Figure 20:
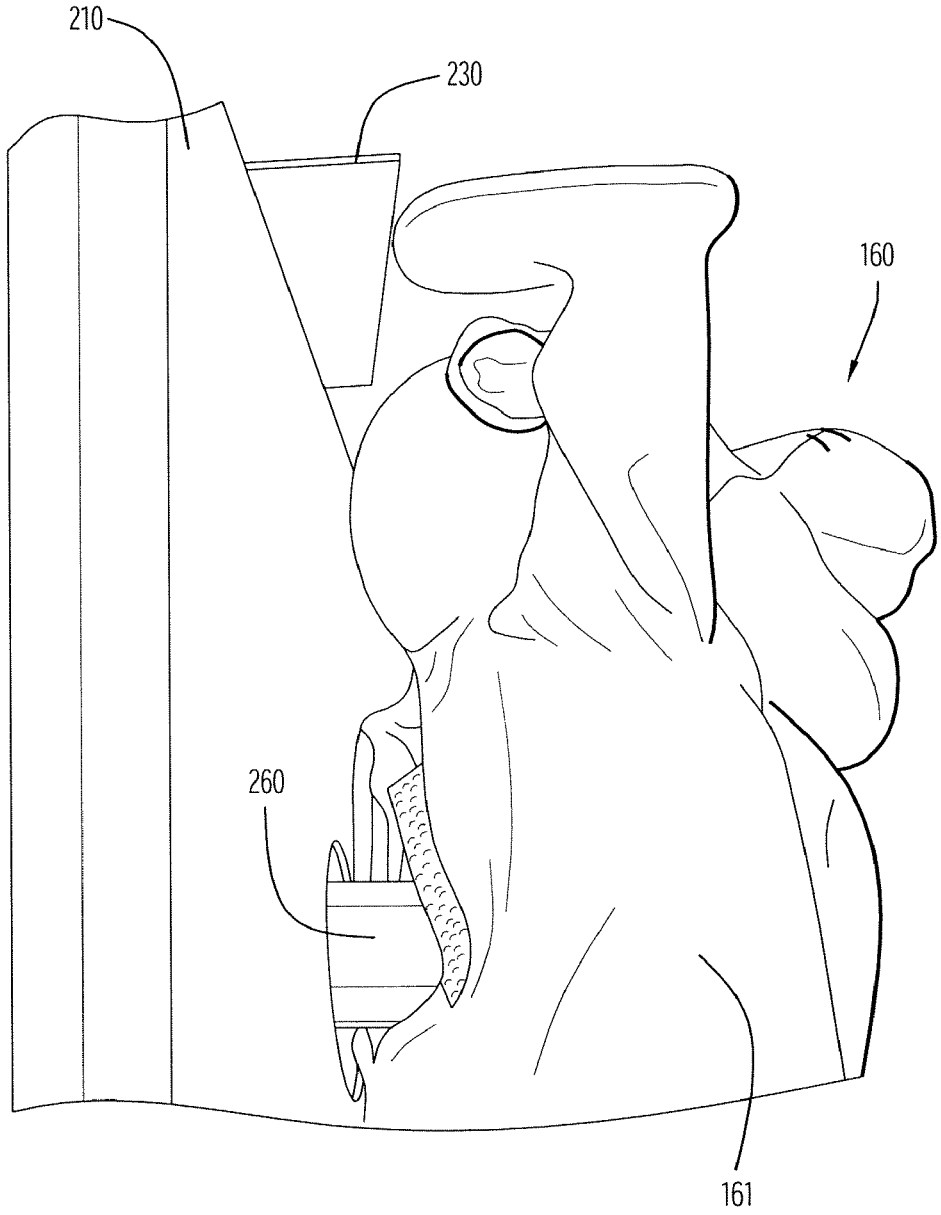
FIG. 20 illustrates a side close-up view of the display packaging of FIG. 16, showing the connection of the toy to the packaging.

FIG. 20 is a close-up of the toy 160 attached to the display package 100, showing the connection of the post 260 into the back side of the torso 161 of the toy 160. As shown, the post 260 extends from the support member 230 through the backing 210 and into the back of the torso 161 of the toy 160. As discussed above, the post 260 engages the animation mechanism of the toy 160. The configuration of the animation mechanism is not limited. Preferably, the animation mechanism is configured to move the toy 160 about the post 260. For example, the animation mechanism may include a tool or shaft contoured to removably engage the socket 268 of the post 260. The shaft is driven by a motor (e.g., a reversible motor). Since the post 260 is secured to the shaft of the drive mechanism (e.g., via fastener 254), the rotation of the shaft causes a corresponding rotation of the toy 160 about the post 260.

Figure 21A:
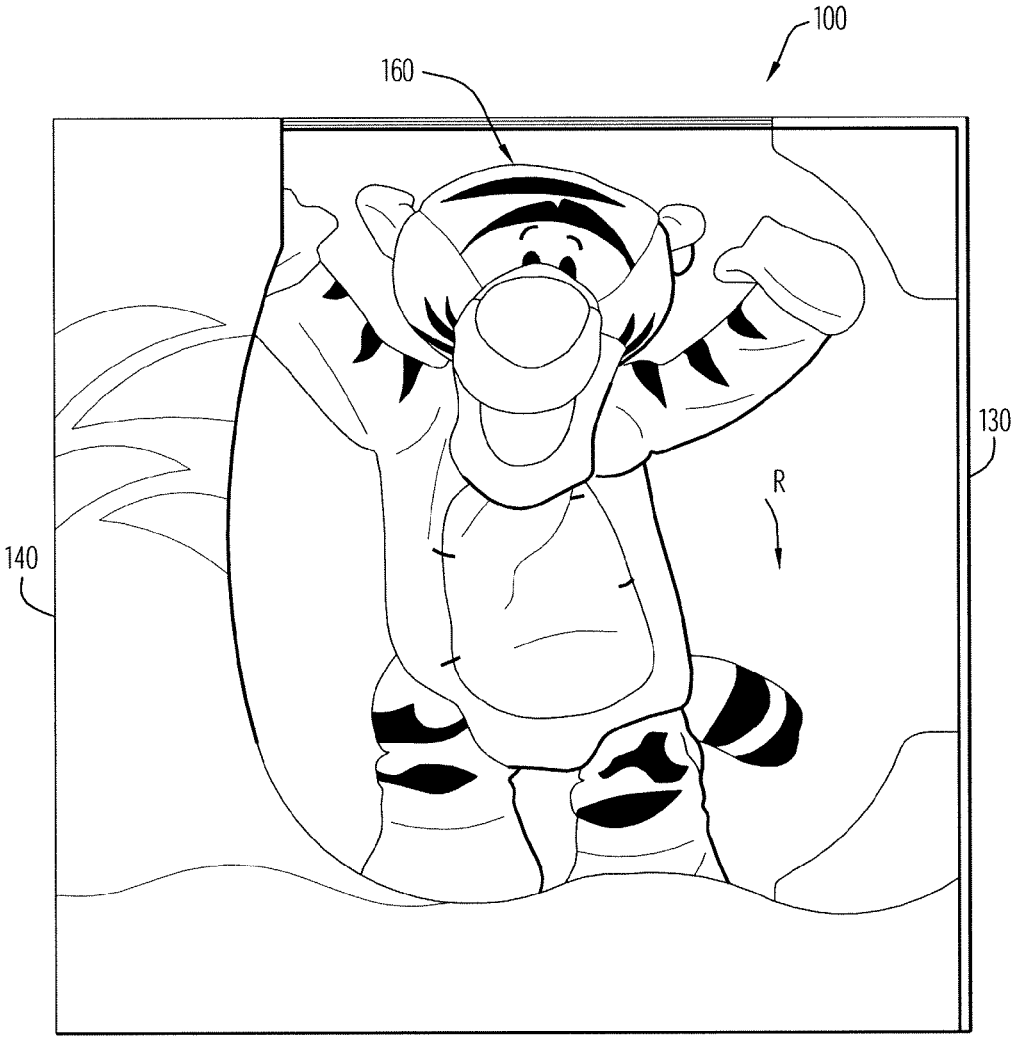
FIGS. 21A and 21B illustrate front views of the display packaging of FIG. 15, showing the movement of the toy within the packaging.
Figure 21B:
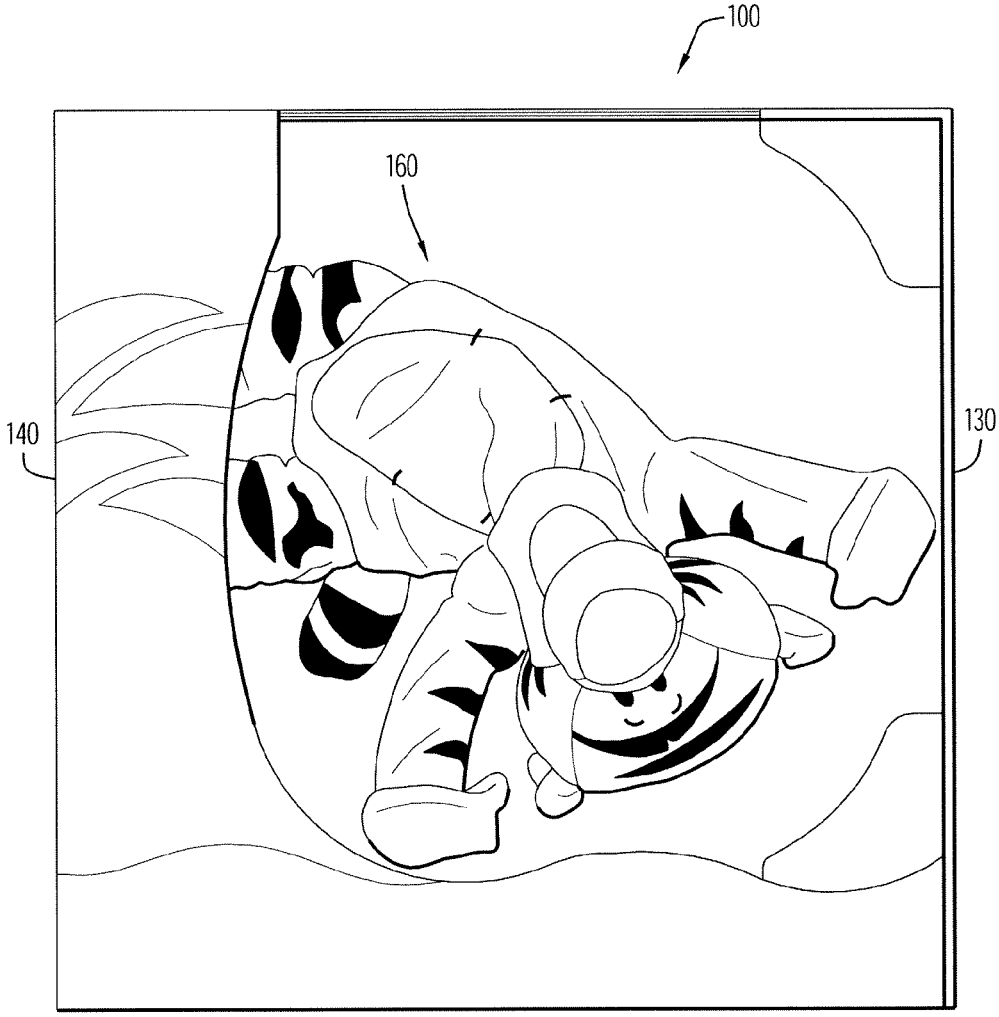

The type of motion of the toy 160 envisioned herein includes, but is not limited to, rotational, pivotal, and lateral movement along the post 260. As shown in FIGS. 21A and 21B, the toy 160 may start in a first display position (e.g., an upright position as illustrated in FIG. 21A) and rotate clockwise or counter clockwise about the post 260 (indicated by arrow R) to a second display position (e.g., a non-upright position as illustrated in FIG. 21B). Thus, the toy 160 appears to tumble sideways (hands over feet) and perform a cartwheel. Alternatively, the toy 160 may be configured to reciprocally pivot about the post 260 (i.e., in a pendulum pattern). In either embodiment, the internal motor of the toy 160 is operable to produce the motion of the toy 160, driving it about the post 260. It is important to note that the driving mechanism, in addition to driving the motion of the toy within the packaging 100, also drives the motion of the toy 160 when removed from the packaging 100.

In operation, the toy 160 is housed in the display package 100, secured to the backing 210 via support member 230. The backing 210 is then connected to the rear portion 200 of the display package 100. A customer may interact with the toy 160 at the point of sale by engaging the toy's try-me feature, which causes the toy 160 to rotate about the post 260, causing portions of the toy to alternately engage with moveable display panel 150 further enhancing the visual appearance of the toy 160 performing cartwheels within the display package 100. The degree of rotation about the post 260 is not limited, and may include 360°. The rotation about the post 260 is generated by a motor within the toy 160, and not by a motor contained in the packaging 100 (a separate drive mechanism to be provided in the packaging 100 is not required, but is envisioned by the present invention). Again, if a display panel 150 is provided, as the toy 160 performs cartwheels, its legs, its head, or its arms may repeatedly contact the display panel, causing it to move from its upper, resting position to its lower, engaged position (not shown). Once purchased, the purchaser removes the toy 160 from the display package 100 by releasing the toy 160 from the post 260. Specifically, the purchaser may access the fastener 254 via the aperture 220 in the rear portion 200 of the display package 100, removing the fastener 254 from the cavity 240 using, e.g., a screw driver. Once removed, the user may interact with the toy 160, engaging the full complement of the toy's animation features.

With this configuration, the animation features of a toy 160 may be demonstrated to a user, while the toy itself is still housed within the packaging 100. A user need not purchase the toy 160 and remove it from the packaging 100 before assessing whether or not the animation features are attractive to the user. The features, moreover, are driven by the toy's internal drive mechanism. A second drive mechanism within the packaging is not required.

While the invention has been described in detail and with reference to specific embodiments thereof, it will be apparent to one skilled in the art that various changes and modifications can be made therein without departing from the spirit and scope thereof. For example, although not specifically illustrated, the display package 100 embodiment illustrated in FIGS. 15-19 may be adapted for use with the packaging attachment 300 described above. Briefly, either one of the side portions 130, 140 of the display package 100 may include a receptacle 170 configured to receive the insert 350 of the packaging attachment 300, while the cover plate 310 may be adapted to fit within the package opening 165 to protect and secure the toy 160 within the display package 100.

In addition, the size and shape of the display package 100 is not limited to that illustrated herein. The materials comprising the display package 100 or the packaging attachment 300 are not limited, and may include conventional paper board, cardboard, flake board, plastic, metal, wood, or other conventional packaging materials. Similarly, the material comprising the biasing member 820 is not limited to that illustrated herein, and may include acetate strips, springs, and/or loops of resiliently flexible material (e.g., conical coils, resilient springs, etc.). The size and shape of the receptacle 170 is not limited to that illustrated herein, and may include any geometric shape sufficient to receive insert 350 of the packaging attachment 300.

Furthermore, although the moveable display panel 150 is shown being associated with the bottom package portion 120, the display panel 150 could just as easily be associated with another portion of the display package 100 (the side portions or the top portion) without departing from the scope of the present invention. For example, the first and second portions 162, 164 of the toy 160 could be the arms of the toy which move in a boxing or a transverse, "patty-cake" motion, and the display panel 150 could be associated with one or more of the side package portions 130, 140. In this arrangement, the repeated movement, e.g., inward and outward movement, of the first and second portions (arms) of the toy 160 would cause a corresponding inward/outward movement of the display panel 150. Additionally, the display panel 150 may be associated with the top portion of the display package 100. Furthermore, the display package 100 may include multiple moveable display panels 150 in multiple different locations for interaction with the toy 160, with the option of one display panel 150 interacting with another of the display panels 150. Finally, the moveable display panel 150 may be formed in other configurations (in addition to the flat display panel 150 shown herein), such as a treadmill or roller configuration that moves with the moveable portion of the toy 160.

The configuration of the support member 230 is not limited to that illustrated herein, and may comprise various shapes and sizes capable of enabling the toy 160 to be reoriented within the display package 100 (e.g., from a first display position to a second display position). The number of support members 230 within the display package 100 is not limited to that illustrated herein. Although illustrated as extending from the rear package portion 200, the post 260 of the support member 230 may be selectively positioned within the display package 100, extending from any one or more of the side walls 130, 140, the bottom package portion 120, or the top package portion 105. In addition, instead of including as a post, the support member 230 may comprise a bar extending from the first side package portion 130 to second side package portion 140. With such an alternative configuration, the toy 160 may be adapted to perform, for example, pull-up motions driven by the motor within the toy 160.

Furthermore, the animation features of the toy 160 are not limited to that illustrated herein, and include leg, arm and head motions, as well as cartwheels, somersaults, and spins. For example, instead of extending into the back of the toy 160, the post 260 may extend into the foot of the toy 160, with an aperture located along bottom portion of the toy's foot. With such a configuration, the toy 160 may be adapted to spin on one foot (pirouette) within the display package 100. In addition, the bottom package portion 120 may include a slot (e.g. a curved slot) configured to repeatedly and reliably guide the motion of the toy 160. Thus, by way of specific example, one foot 162 of the toy FIG. 160 may engage the post 260, while the other foot 164 may engage the slot. The drive mechanism of the toy 160 may then pivot the figure in a predetermined pattern (e.g., a 90° pivot), with the slot helping to guide the toy 160 in such motion.

Thus, it is intended that the present invention covers the modifications and variations of this invention provided they come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. An animated toy display package comprising:

a toy including a drive mechanism moving at least a portion of the toy from a first toy position to a second toy position;

an enclosure for the animated toy, the enclosure including:

a rear package portion, a front package portion, side package portions extending between the rear package portion and the front package portion, and a bottom package portion; and a support member supporting the toy within the enclosure, the support member comprising a support beam coupled to the enclosure and a post extending distally from the beam, wherein the post engages the drive mechanism of the toy, wherein the drive mechanism, when engaged by the post, rotates the toy about the post to reorient the toy within the enclosure from said first toy position to said second toy position.

2. The display package of claim 1, wherein the toy includes a receptacle that receives the post.

3. The display package of claim 1, wherein a distal end of the post is keyed to mate with the drive mechanism.

4. The display package of claim 3, wherein:

the drive mechanism includes a shaft housed within the toy; and the distal end of the post includes a socket contoured to mate with the shaft of the drive mechanism.

5. The display package of claim 1, wherein the drive mechanism is configured to rotate the toy 360° within the enclosure.

6. The display package of claim 1, wherein:

the support beam comprises a generally upright, substantially rigid beam;

the post is in the form of a rigid bar extending into the enclosure; and a distal end of the bar comprises a socket configured to mate with a shaft housed within the toy.

7. The display package of claim 6, wherein:

the support beam is a generally I-shaped beam extending upward from the bottom package portion; and the post is oriented orthogonal to the beam.

8. An animated toy display package comprising:

an animated toy including a drive mechanism housed within the toy, wherein the drive mechanism is animates a portion of the toy;

an enclosure for the animated toy, the enclosure including a bottom package portion and a rear package portion extending upward from the bottom package portion;

a support member supporting the toy within the enclosure, the support member including a substantially rigid support beam and a substantially rigid post extending from the support beam, wherein the post couples to the drive mechanism housed within the animated toy, and wherein the drive mechanism rotates the toy along the post, driving the toy from a first display position to a second display position while housed within the enclosure.

9. The display package of claim 8, wherein:

the animated toy includes an opening selectively covered by a spring biased door; and the post passes through the opening and into the animated toy.

10. The display package of claim 8, wherein the post includes a proximal end connected to the support beam and a distal end keyed to mate with a component of the drive mechanism.

11. The display package of claim 10, wherein:

the drive mechanism component comprises a shaft housed within the toy; and the distal end of the post includes a socket that receives the shaft of the drive mechanism.

12. The display package of claim 10, wherein the drive mechanism rotates the toy 360° within the enclosure.

13. The display package of claim 8 further comprising a releasable fastener that connects the toy to the post.

14. The display package of claim 8, wherein:

the drive mechanism includes a shaft driven by a motor;

the support beam comprises a generally I-shaped beam extending upward from the bottom package portion; and the post comprises a generally cylindrical bar oriented orthogonal to the support beam, the bar including a socket configured to mate with the shaft of the drive mechanism.

15. The display package of claim 8, wherein:

the animated toy includes a body and a toy portion operable to move from a first toy portion position to a second toy portion position;

the drive mechanism is housed within the toy body; and the drive mechanism is further configured to move the toy portion from the first toy portion position to the second toy portion position.

16. The display package of claim 8, wherein the enclosure further comprises a front package portion and side package portions extending between the front and rear package portions.

17. The display package of claim 8, wherein the drive mechanism generates a first set of animation features while the toy is coupled to the post and a second set of animation features when the toy is removed from the post.

* * * * *